US008028755B2

(12) United States Patent
Darnell et al.

(10) Patent No.: US 8,028,755 B2
(45) Date of Patent: Oct. 4, 2011

(54) QUICK LOCK WIRELINE VALVE/BLOW-OUT PREVENTOR AND METHODS FOR MAKING AND USING SAME

(75) Inventors: David Trevor Darnell, Great Yarmouth (GB); Robert Andrew Hunt, Bradwell (GB)

(73) Assignee: Clearwater International LLC, Houston, TX (US)

( * ) Notice: Subject to any disclaimer, the term of this patent is extended or adjusted under 35 U.S.C. 154(b) by 267 days.

(21) Appl. No.: 11/956,433

(22) Filed: Dec. 14, 2007

(65) Prior Publication Data

US 2009/0151959 A1 Jun. 18, 2009

(51) Int. Cl.
*E21B 33/06* (2006.01)

(52) U.S. Cl. ..... 166/379; 166/85.4; 251/1.3

(58) Field of Classification Search ..... 166/379, 166/85.1, 85.4; 251/1.3, 1.1
See application file for complete search history.

(56) References Cited

U.S. PATENT DOCUMENTS

| | | | | |
|---|---|---|---|---|
| 3,647,174 | A | 3/1972 | LeRouax | |
| 3,670,761 | A | 6/1972 | LeRouax | |
| 3,871,613 | A | 3/1975 | LeRouax | |
| 4,214,605 | A | 7/1980 | Hardgrave | |
| 4,519,571 | A | 5/1985 | Jones et al. | |
| 4,638,972 | A | 1/1987 | Jones et al. | |
| 4,877,217 | A | 10/1989 | Peil et al. | |
| 5,056,418 | A * | 10/1991 | Granger et al. | 92/24 |
| 5,287,879 | A | 2/1994 | Leggett et al. | |
| 6,510,897 | B2 * | 1/2003 | Hemphill | 166/373 |
| 6,554,247 | B2 * | 4/2003 | Berckenhoff et al. | 251/1.3 |
| 6,845,958 | B2 | 1/2005 | Wood et al. | |
| 6,845,959 | B2 * | 1/2005 | Berckenhoff et al. | 251/1.3 |
| 7,051,989 | B2 * | 5/2006 | Springett et al. | 251/1.1 |
| 7,096,960 | B2 * | 8/2006 | Hemphill et al. | 166/373 |
| 7,121,348 | B2 * | 10/2006 | Hemphill et al. | 166/373 |
| 7,246,666 | B2 * | 7/2007 | Hemphill et al. | 166/373 |
| 7,281,586 | B2 * | 10/2007 | Hemphill et al. | 166/373 |
| 2002/0162663 | A1 * | 11/2002 | Hemphill | 166/373 |
| 2002/0162981 | A1 * | 11/2002 | Berckenhoff et al. | 251/1.1 |
| 2003/0075699 | A1 * | 4/2003 | Wood et al. | 251/1.3 |
| 2004/0003920 | A1 * | 1/2004 | Boyd | 166/85.4 |
| 2004/0021102 | A1 * | 2/2004 | Berckenhoff et al. | 251/1.1 |
| 2007/0102656 | A1 * | 5/2007 | Hemphill et al. | 251/1.3 |
| 2008/0142746 | A1 * | 6/2008 | Hemphill et al. | 251/1.3 |
| 2009/0151959 | A1 * | 6/2009 | Darnell et al. | 166/379 |

FOREIGN PATENT DOCUMENTS

| | | |
|---|---|---|
| GB | 2112837 | 7/1983 |

OTHER PUBLICATIONS

Koomey Inc. vol. 4, J-Line, Blowout Preventers, p. 4 (1986).

* cited by examiner

*Primary Examiner* — Jennifer H Gay
(74) *Attorney, Agent, or Firm* — Robert W Strozier

(57) ABSTRACT

A blow out preventor (BOP) apparatus is disclosed including a quick connection system. The quick connection system comprises at least one actuator receiving aperture including at least one female connector having a female engaging profile and at least actuator cylinder including at least one male connector having a male engaging profile, where the male engaging profile is adapted to register with the female engaging profile upon insertion of an actuator into its corresponding receiving aperture and upon rotation of the actuator through a rotational angle.

54 Claims, 18 Drawing Sheets

QUICK CONNECTION SYSTEM – SINGLE CONNECTION
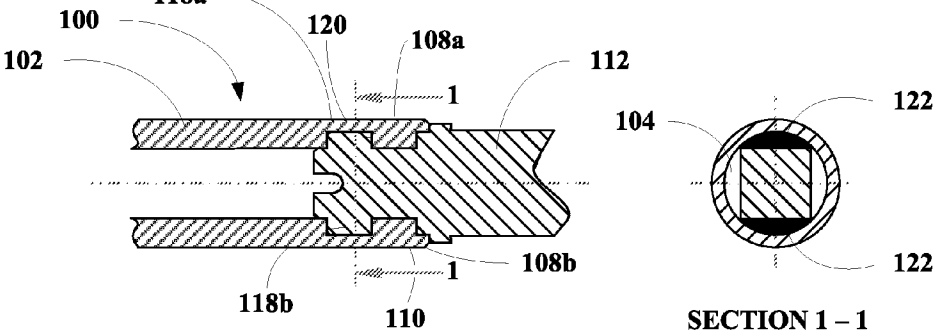
FIG. 1A
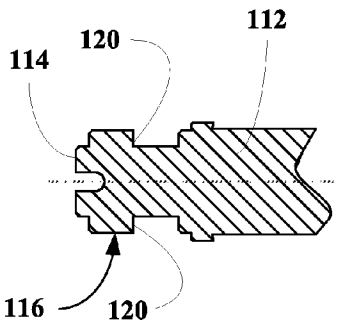
FIG. 1B
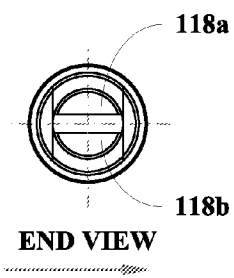
FIG. 1E
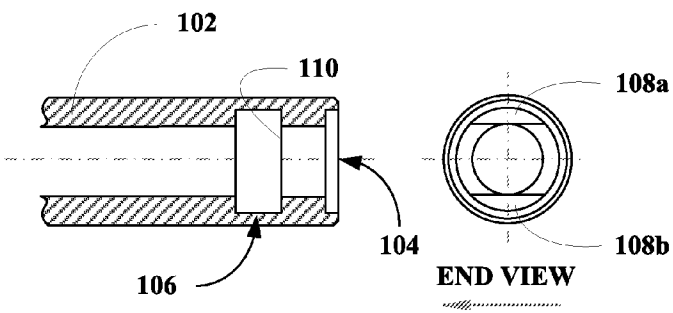
FIG. 1C
FIG. 1D
FIG. 1F QUICK CONNECTION SYSTEM – TWO CONNECTIONS
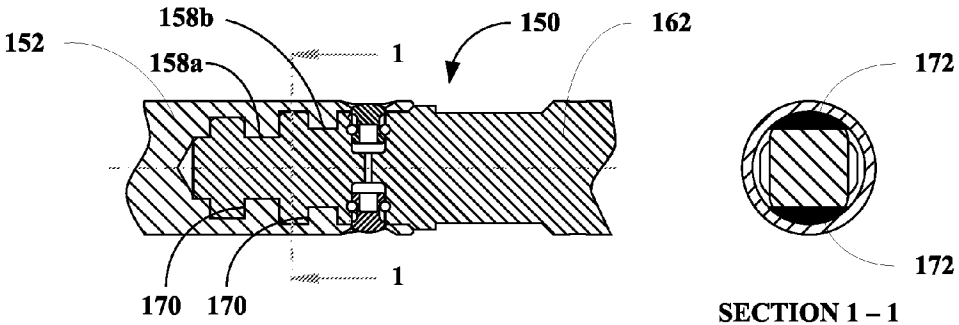
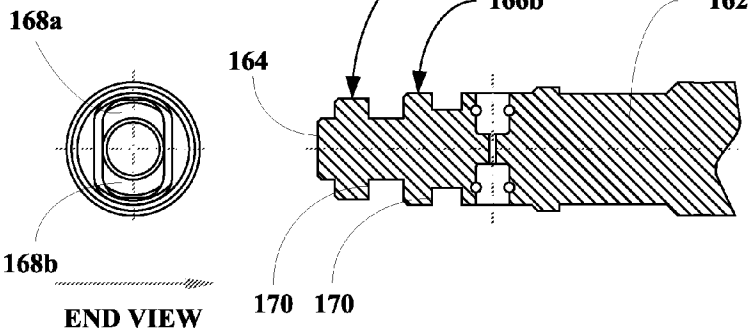
FIG. 1H
FIG. 1K
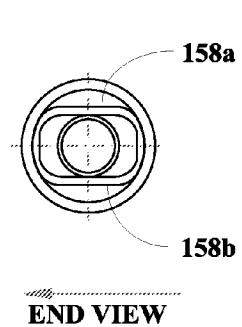
FIG. 1G
FIG. 1L
FIG. 1J
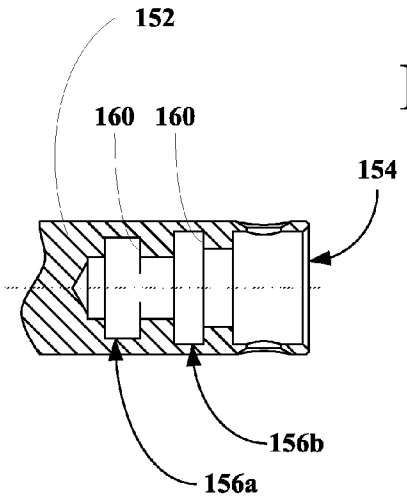
FIG. 1I

CONTACT SURFACE ANGLE

TWO LUG BODY

SECTION 2-2

SECTION 3-3

SECTION 1-1

1
340
336
338
342
334
330

354
344
346
348

350
352
SECTION 1-1

SEAL RING / SEAL PLATE

SECTION 1-1

SECTION 2-2

KEY / DETENT KEY

TWO LUG CONNECTOR DESIGN WITH SEAL PLATE IN UNLOCKED STATE
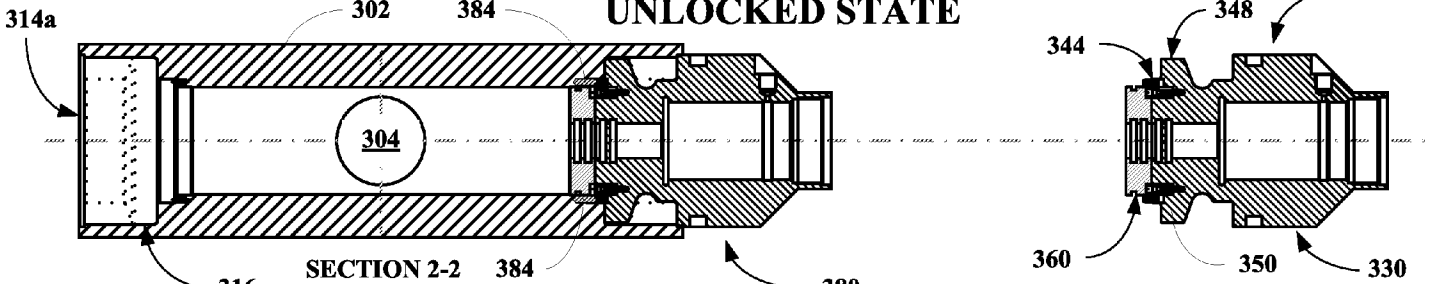
FIG. 3O
FIG. 3P
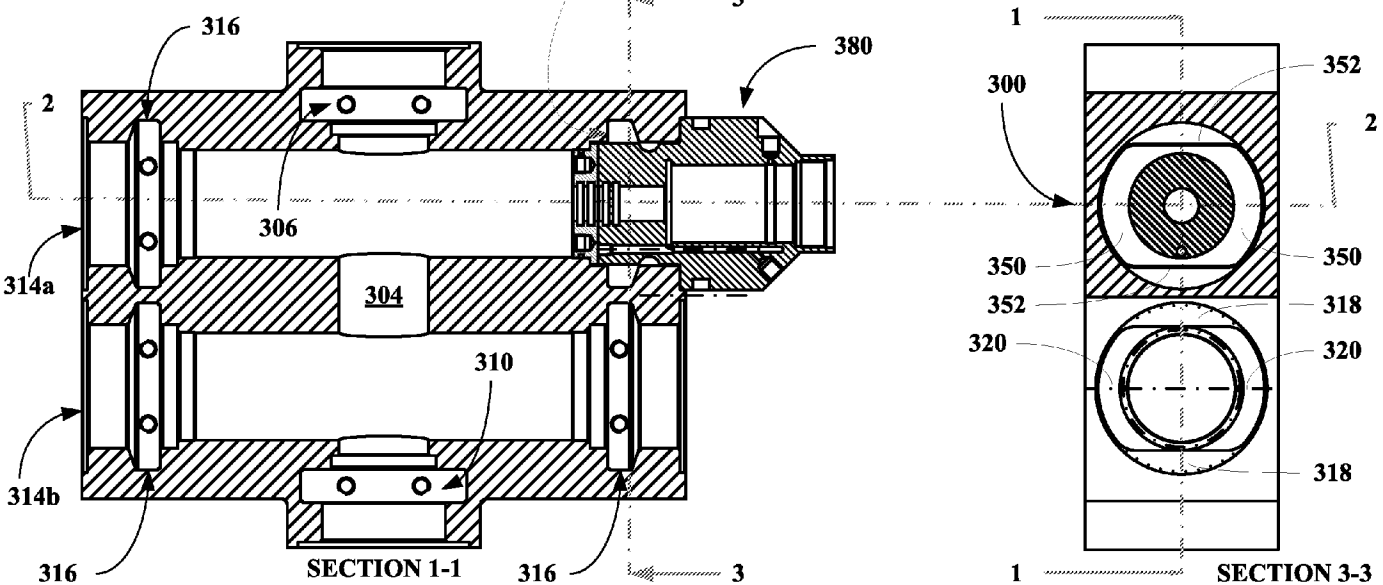
FIG. 3R
FIG. 3Q

TWO LUG CONNECTOR DESIGN WITH SEAL PLATE IN LOCKED STATE

4 LUG BODY

4 LUG CYLINDER

Section 1-1

Section 3-3

Section 2-2

4 LUG CONNECTION SYSTEM IN ITS UNLOCKED STATE
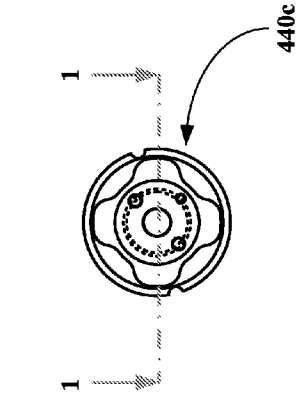
FIG. 4I
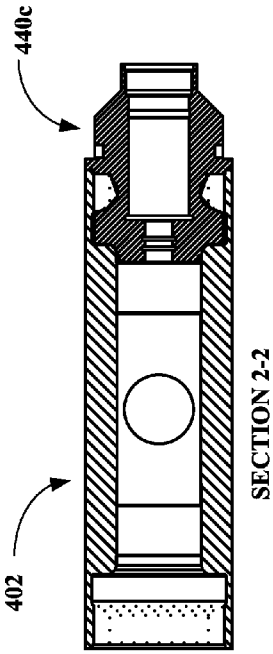
FIG. 4J
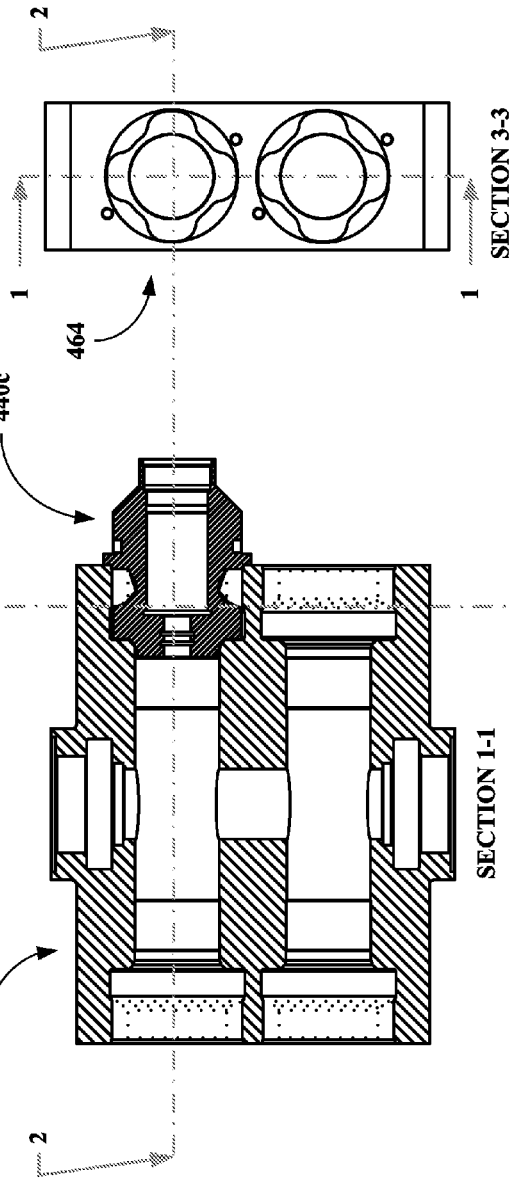
FIG. 4L
FIG. 4K 4 LUG CONNECTION SYSTEM IN ITS LOCKED STATE
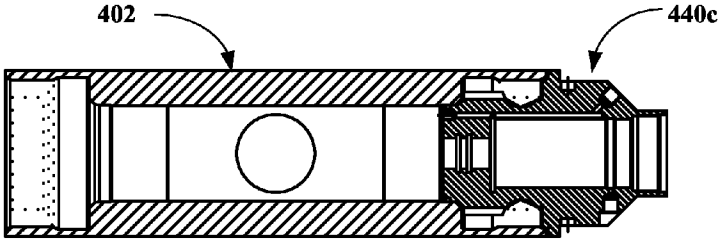
SECTION 2-2
FIG. 4M
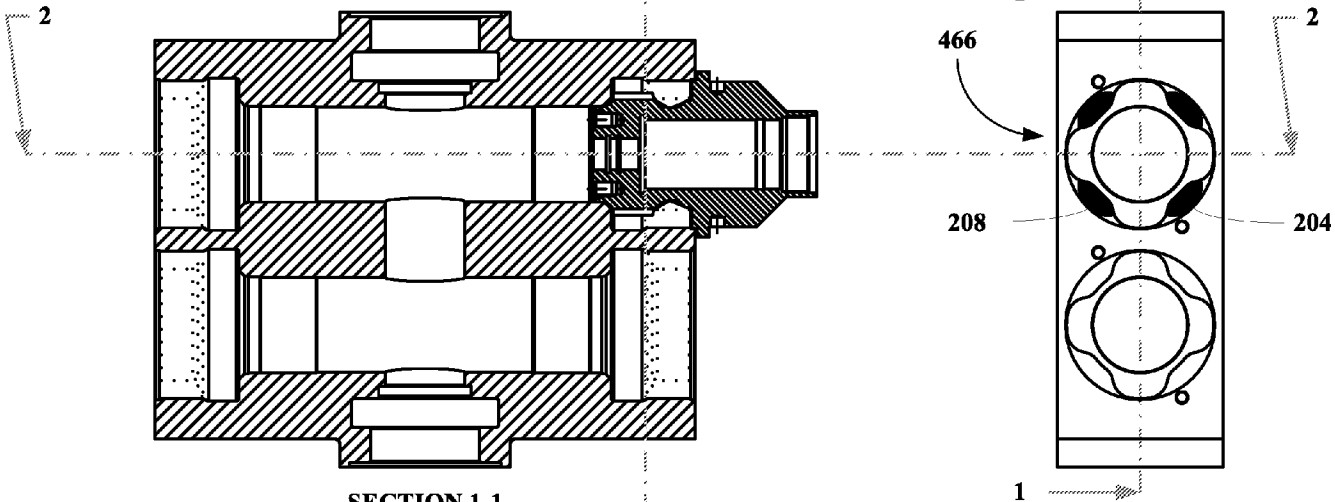
SECTION 3-3
FIG. 4O
SECTION 1-1
FIG. 4N

ACTUATOR OF THIS INVENTION
HAVING CONVENTIONAL PISTON ROD SEALS

ACTUATOR OF THIS INVENTION
HAVING A PISTON ROD SEAL CARTRIDGE

Seal Cartridge

QUICK LOCK WIRELINE VALVE/BLOW-OUT PREVENTOR AND METHODS FOR MAKING AND USING SAME

BACKGROUND OF THE INVENTION

1. Field of the Invention

The present invention relates to a quick lock actuator and blowout preventor apparatus for use in oil field and other hydraulic applications and to methods for making and using same. This invention relates to a pressure valve and particularly, but not exclusively, to drilling, completion and rework valves used to in wireline, slick line, measuring bar, deployment bar, coiled tubing, drilling, or other operations requiring entry into high pressure assembly such as oil and/or gas well or other similar operations in the oil, gas, refining, chemical, or industrial industries. These valves are commonly known in the industry as Blow-Out Preventors (BOPs).

More particularly, the present invention relates to a quick lock actuator and blowout preventor apparatus for using in oil field and other hydraulic applications, where the apparatus includes a blow out preventor having at least one receiving aperture, two opposing receiving apertures, or a plurality of pairs of opposing receiving apertures adapted to receive a quick lock actuator for engaging a wireline. Each receiving apertures includes a profiled connector designed to engage a mating profiled actuator connector, where the profiled connectors include contacting surfaces so that when the actuator is inserted into the receiving aperture and rotated, the contacting surfaces of the connectors engage locking the actuator in place. The present invention also relates to methods for making and using same.

2. Description of the Related Art

Wireline BOPs are provided for oil and gas wells in order to seal off the wellbore. Typically, wireline BOPs comprise one or more pairs of actuators which are hydraulically activated to close the well, resisting the well fluids and thereby preventing well blow-out.

Many blow out preventors and wireline actuating devices have been described in the prior art including those described in U.S. Pat. Nos. 3,647,174, 3,670,761, 3,871,613, 4,214,605, 4,519,571, 4,638,972, 4,877,217, 5,287,879, 6,845,958, incorporated herein by reference.

However, each of the blowout preventors of the prior are and the wire line actuating devices have certain draw backs. Thus, there is still a need in the art for a blowout preventor and wire line actuator that permits fast and quick decoupling and actuator exchange to accommodate different wire line type and sizes.

SUMMARY OF THE INVENTION

The present invention provides an embodiment of an apparatus capable of resisting a flow of fluids through a bore, where the apparatus includes a blowout preventor BOP assembly having a body, a wireline aperture therethrough, a top fitting and a bottom fitting (known as quick unions) associated with the wireline aperture, and at least one receiving aperture and an equal number of actuator assemblies. Each receiving aperture and its corresponding actuator assembly comprise a quick lock connecting system. Each actuator assembly includes at least one male connector and each receiving aperture includes at least one female connector, where the female connectors are adapted to be received and to seat in the male connectors so that upon rotation of the actuator or portion thereof, the male connector engages the female connector in a locking manner. Each actuator assembly includes a distal portion and a proximal portion. The distal portion including a distal end is adapted to be inserted or stabbed into a corresponding receiving aperture of the BOP assembly. The distal portion also includes the male connectors of the quick connect connecting means or system. While the proximal portion including a lead screw assembly adapted to serve as a backup system to an hydraulic portion of the actuator, where the hydraulic portion is adapted to transition the actuator between an opened configuration and a closed configuration. The opened configuration allows a ram in contact with the first end of the actuator to move permitting fluid flow through the bore, and the closed configuration allows the rams to move forward into the aperture to resist fluid flow through the bore. The lead screw assembly is also adapted to permit manual closing of the rams. The actuator can be of varying diameters. The top and bottom fittings can be traditional fittings or can be the quick lock connectors of this invention including a BOP female connector having an engagement profile and a female connector having a matching engagement profile so that the fittings are rotationally locked.

The present invention also provides another embodiment quick connect BOP/actuator apparatus that includes a blowout preventor (BOP) assembly having a body, a wireline aperture therethrough, a top fitting and a bottom fitting (known as quick unions) associated with the wireline aperture, and at least one pair of opposing receiving apertures and an equal number of actuator assemblies. Each receiving aperture and its corresponding actuator assembly comprise a quick lock connecting system Each actuator assembly includes at least one male connector and each receiving aperture includes at least one female connector, where the female connectors are adapted to be receive and to seat in the male connectors so that upon rotation of the actuator or portion thereof, the male connector engages the female connector in a locking manner. Each actuator assembly includes a distal portion and a proximal portion. The distal portion including a distal end is adapted to be inserted or stabbed into a corresponding receiving aperture of the BOP assembly. Each actuator assembly also includes a ram and corresponding ram seals disposed at its distal end. The distal portion also includes the male connectors of the quick connect connecting means or system. While the proximal portion includes a lead screw assembly adapted to serve as a backup system to an hydraulic portion of the actuator, where the hydraulic portion is adapted to transition the actuator between an opened configuration and a closed configuration. The opened configuration of the actuators and associated rams permit fluid flow through the wireline aperture, while the closed configuration of the actuator and associated rams resist fluid flow through the wireline aperture. The apparatus further comprising the hydraulic assembly adapted to transition the actuator assembly between its opened and closed configurations. The hydraulic assembly comprises a piston with a first end and a second end, each end being sealed within a hydraulic chamber of the actuator assembly by first and second sealing mechanisms, where a hydraulic fluid is used to move the piston so that the actuator assembly and associated rams transition between their opened and closed configurations. The first sealing mechanism provides a smaller cross sectional sealing area than the second sealing means. The actuator can be of varying diameters.

The present invention also provides another embodiment quick connect BOP/actuator apparatus capable of resisting a flow of fluids through a bore, where the apparatus includes a blowout preventor BOP assembly having a body, a wireline aperture therethrough, a top fitting and a bottom fitting (known as quick unions) associated with the wireline aperture, and a plurality of pairs of opposing receiving apertures and an equal number of actuator assemblies. Each receiving aperture and its corresponding actuator assembly comprise a quick lock connecting system Each actuator assembly includes at least one male connector and each receiving aperture includes at least one female connector, where the female connectors are adapted to be received and to seat in the male connectors so that upon rotation of the actuator or portion thereof, the male connector engages the female connector in a locking manner. Each actuator assembly includes a distal portion and a proximal portion. The distal portion including a distal end is adapted to be inserted or stabbed into a corresponding receiving aperture of the BOP assembly. Each actuator assembly also includes a ram and corresponding ram seals disposed at its distal end. The distal portion also includes the male connectors of the quick connect connecting means or system. While the proximal portion includes a lead screw assembly adapted to serve as a backup system to an hydraulic portion of the actuator, where the hydraulic portion is adapted to transition the actuator between an opened configuration and a closed configuration. The opened configuration of the actuators and associated rams permit fluid flow through the wireline aperture, while the closed configuration of the actuator and associated rams resist fluid flow through the wireline aperture. The apparatus further comprising the hydraulic assembly adapted to transition the actuator assembly between its opened and closed configurations. The hydraulic assembly comprises a piston with a first end and a second end, each end being sealed within a hydraulic chamber of the actuator assembly by first and second sealing mechanisms, where a hydraulic fluid is used to move the piston so that the actuator assembly and associated rams transition between their opened and closed configurations. The first sealing mechanism provides a smaller cross sectional sealing area than the second sealing means. The actuator can be of varying diameters.

The present invention also provides a method for preparing a BOP/actuator apparatus of this invention including the step of providing a BOP assembly including a wireline aperture therethrough, a top fitting and a bottom fitting (known as quick unions) associated with the wireline aperture, and at least one receiving aperture having at least one channel connector that includes an engaging profile having at least one lip or overhang and at least one non-lipped portion adapted to register with a connector on an actuator cylinder having a connector. The term channel is not meant to limit the nature of the connector, but is merely used as a way to refer to the connector, which is simply disposed on an interior of the receiving aperture and is capable of engaging a corresponding connector on the actuator. The method also includes providing an equal number of actuators and rams, one for each receiving aperture, where each actuator includes an actuator connector including a corresponding engaging profile including at least one flange or lug and at least one recessed region. The profiles are designed so that the actuator connector can seat in the channel connector with its lugs or flanges disposed in the non-lipped portions of the channel connector. Once seated or properly aligned, the actuator or a portion is rotated so that the flanges slide beneath the lips forming a quick lock connection between the receiving aperture channel connector and the actuator connector. The connection comprises at least one contacting zone including a contacting surface of a lip and a corresponding lug. The actuators also include ram guides and ram pins for proper ram alignment and to facilitate transitioning of the actuators and rams between their closed and opened configurations.

The present invention also provides a method for performing wireline operations on a well using a BOP/actuator apparatus of this invention including the step of providing a BOP of this invention including top and bottom fitting (known as quick unions), a wireline aperture therethrough, at least one receiving aperture having a channel connector that includes at least one lip or overhang. The apparatus also includes an equal number of actuators and rams, one of each for each receiving aperture, where each actuator includes an actuator connector including at least one flange and at least one recessed region for each lip or overhang so that when the actuator connector is disposed within the channel, the recessed regions align with the lips and the flanges align with the non-lipped portions of the channel. Once aligned, the actuator is rotated so that the flanges slide beneath the lips forming a quick lock connection between the receiving aperture channel connector and the actuator connector. The actuators also include ram guides and ram pins for proper ram alignment and to facilitate transitioning of the actuators and rams between their closed and opened configurations.

The present invention also provides a removable piston rod seal cartridge and an actuator adapted to receive a removable piston rod seal cartridge. The cartridge includes a body having a proximal end, a distal end, a central aperture adapted to receive a piston rod, and at least one groove disposed in the central aperture adapted to receive piston rod seals. The cartridge also includes a connector s at its proximal end such as a threaded connector, a snap connector, a quick lock connector, or any other connector designed to lockingly hold the cartridge into the actuator. The cartridge connectors is adapted to lockingly engage a connector in a proximal end of a cartridge aperture disposed in a distal end of an actuator cylinder of this invention. The cartridge also includes at least one groove in an exterior surface of the cartridge body towards its distal end adapted to receive a seal such as an o-ring to seal the cartridge body against the cartridge aperture in the actuator cylinder. The cartridge may also include apertures in its proximal face to assist in cartridge insertion, connection making, connection breaking and removal.

The present invention also provides a method for replacing piston rod seals, including the step of sliding an actuator onto a telescoping rail to expose a ram and the actuator. Removing the ram to expose the distal end of the actuator. Once the actuator end is exposed, a piston rod seal cartridge can be disconnected from its aperture in the distal end of the actuator. Once removed, a new cartridge can be inserted into the aperture. The ram can be reattached and the actuator slid back into place in the BOP for continued operation.

BRIEF DESCRIPTION OF THE DRAWINGS

The invention can be better understood with reference to the following detailed description together with the appended illustrative drawings in which like elements are numbered the same:

FIGS. 1A-F depict an illustration of a quick connect system of this invention including a single row of a two lug connector system.

FIGS. 1G-L depict an illustration of a quick connect system of this invention including two rows of a two lug connector system.

FIGS. 3O-R depict the two lug connecting system of this invention in its unlocked configuration before insertion and rotation to lock the connection.

FIGS. 4I-L illustrate the BOP body of FIGS. 4B-D where a single cylinder is inserted and the actuator connection is properly seated in the channel connector of one of the receiving apertures.

FIGS. 4M-O illustrate the BOP body of FIGS. 4B-D where a single cylinder has been inserted and properly seated after rotation to lock the cylinder in place.

DETAILED DESCRIPTION OF THE INVENTION

Figure 2B:
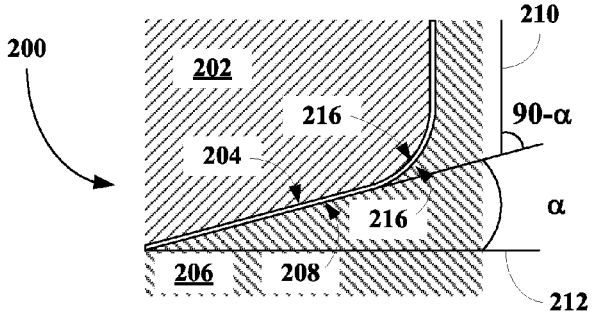
FIGS. 2A-C depict embodiments of the lip and flange design at the contacting surfaces, where the contacting surfaces are angled relative to either a horizontal or vertical axis.

The inventors have found that a BOP apparatus including a body and actuators can be constructed with a quick lock connection system that permits easy insertion, locking, unlocking and removal of the actuators from the BOP body. In general BOP operation, it is sometimes required to change quick union crossovers, whereas the actuators on a BOP apparatus may have to be removed on a much more frequent basis (sometimes offshore) to: (a) replace worn ram seals, (b) redress for a different wire size (blind seals cover all slick line sizes but inner seals and wire guides are sized for each diameter of braided wire), (c) invert the lower rams for grease injection or (d) change out to shear seal rams. Because of the difficulties in removing the actuators it is not uncommon to take more than one BOP on a job to avoid these problems. The use of a quick lock connection system of this invention eliminates the difficulties associated with quick removal of actuators that plague actuators that included threaded or studded flange fittings.

In certain embodiments, the quick lock connection system of this invention includes a separate seal plate to minimize a hydraulic seal area and allow the cylinder of the actuators to rotate without in turn rotating the rams. The quick lock connection system of this invention can also include spring loaded detent keys to allow proper alignment of the seal plate to the actuator distal end and alignment of the seal plate and the ram ensuring that the actuators and rams are automatically and correctly positioned and oriented.

In other embodiments, the BOP body and the actuators are designed to form a quick lock connection system of this invention that does not require a separate seal plate, where the distal end of the cylinder itself serves as a seal plate. In these embodiments, the detent keys are not required for proper alignment of the actuator, seal plate and ram.

In other embodiments of the BOP apparatus of this invention, the actuator can be a purely manually operated actuator with no hydraulic components, i.e., the lead screw assembly is used to manually transition the rams from there opened configuration to their closed configuration. Of course, the actuator still includes a male connector having a male engaging profiled to engage a matching female profile of a receiving aperture in the BOP body.

In other embodiments of the BOP apparatus of this invention, the BOP body can include one or a plurality of protrusion, each protrusion including male connectors having a male engaging profile and a central aperture and an equal number of actuators, each actuator including a female connector including a matching female engaging profiled and an insert adapted to go into the central aperture. The actuator can be purely manually operated or purely hydraulically operated, with a lead screw assembly backup.

In other embodiments, the apparatus of this invention can also comprise a manifold valve including a plurality of flow through apertures. Each aperture includes a male or female connector having a first engaging profile. The manifold valve also includes an equal number of fittings associated with flow paths or stops that includes a female or male connector having a second engaging profile, where the connectors comprise a quick lock connection system of this invention. By inserting one or more connectors associated with flow paths and one or more stops, the flow through the valve can be controlled. The quick lock connecting system provides a fast and efficient system for redirecting flow through the valve to accommodate multiple flow paths and to permit fast and efficient redirection of flow paths by disconnecting and connecting different connectors to the apertures.

Some unique features of this invention allow for easier and quicker redress, not requiring the use of any specialist or dedicated tooling. Although this invention is described for a Wireline Valve/BOP, it is applicable to any pressure retaining valve or manifold. Unlike, conventional BOP designs that fall into three main types: (A) Flange fittings requiring the use of specialist bolt tensioning equipment to ensure correct preload, (B) Threaded fittings requiring a large "C" spanner, and (C) Lock Plate—the cylinder has a turned annular groove and the body is slotted to take two "U" plates from either side, where actuator exchange is difficult in service, the BOP apparatuses of this invention make actuator exchange in service relatively easy.

The present invention broadly relates to a BOP/actuator apparatus including a BOP body assembly including at least one receiving aperture, each aperture having at least one connector, at least one female connector. The apparatus also includes an equal number of actuators, one for each receiving aperture, each actuator including a corresponding number of actuator connectors, male connectors. The two connectors are designed to form a quick lock connecting system for inserting and locking the actuators into the BOP apertures. The apparatus also includes rams and corresponding ram seals disposed on the distal end of the actuators, where the actuators allow the rams to transition between a closed state and an opened state. The male and female connectors comprise opposing profiles including one contacting surface or a plurality of contacting surfaces so that when the actuators are stabbed into the apertures and rotated by a certain amount, the contacting surfaces engage locking the actuator into the apertures. Generally, the apparatus also includes retaining rods that prevent the actuator from rotating during operations.

All of the embodiments of this invention include a means for preventing the actuator from rotating after the actuator has been locked into place after insertion and rotation. In certain embodiments, the rotation preventing means comprises a set of screws that are forced to engage the lugs when the lugs are in their locked state. These screws are associated with the channel connectors of the receiving apertures of the BOP body.

In practice, an actuator assembly is adapted to be inserted or stabbed into a receiving aperture of the BOP body assembly. The receiving apertures include at least one connector including at least one engaging lip protruding into the aperture. If the channel includes more than one lip, then each lip is separated by a straight or unlipped portion of the channel. Each actuator assembly includes an actuator flanged connector including at least one flange and at least one recessed region. If the actuator connector includes more than one flange, then each flange is separated by a recessed region. The actuator connector is configured so that when the actuator is inserted or stabbed into its receiving aperture, the actuator flanged connector fits into the channel connector with the lip(s) of the channel connector disposed in the recessed region (s) of the actuator connector and the flange(s) of the channel connector disposed within the non-lipped portion(s) of the channel connector. Once the connectors are properly aligned, the actuator is rotated so that the flanges slide under the lips or overhangs so that the actuator cannot move in or out, locking the actuator in place.

The number of flanges of the actuator connector and lips of the channel connector is a matter of design necessities, size, pressure to be endured, usage, etc. Generally, the number of flanges and recessed areas and corresponding lips and non-lipped portions can range between 1 to an arbitrary large number generally less than about 25. For large systems, the number of flanges and recessed areas and corresponding lips and non-lipped portions can range between about 1 and about 10; while for smaller systems including microsystem, the number of flanges and recessed areas and corresponding lips and non-lipped portions can range between about 4 and about 25. The flanges or lugs can be symmetrically distributed or non-symmetrically distributed about the circumference of the connector; provided, of course that the channel connector have a corresponding profile, where the profiles are designed to permit the cylinder to be rotated through an angle to lock the flanged connector into the channel connector. Moreover, the size of the flanges and lips, the amount the extend out or in, is that size sufficient to lock the actuator into the aperture and keep the actuator in place during BOP operations.

In certain embodiments, contacting faces of flanges and the lips are designed to oriented at an angle of about 90° with respect to an interior wall of the channel of the channel connector which is substantially parallel to a center axis of the aperture, perpendicular to the well head. In other embodiments, the angle ranges between about 60° and about 120°. In other embodiment, the angle range between about 60° and about 90°. In other embodiments, the angle range between about 70° and about 90°. In other embodiment, the angle range between about 90° and about 120°. In other embodiment, the angle range between about 90° and about 110°. Alternatively, the angle can be defined relative to an axis perpendicular to the center axis of the aperture. The angle so defined ranges between −30° and +30°. In certain embodiments, the angle ranges between −20° and +20°. In certain embodiments, the angle ranges between 0° and 30°. In certain embodiments, the angle ranges between 0° and 20°.

The present invention also broadly relates to a method for wireline operations downhole including the step of attaching a fully assembled BOP apparatus of this invention to a top of a well bore. Once the BOP is attached to the well bore, a wire line or other line is inserted into a lubricator which is fitted on top of the BOP apparatus with the actuators in their closed configuration. The BOP is used to control well pressure when deploying or retrieving a tool string from the wellbore. It acts like a conventional valve. When the actuators are in their opened configurations, the BOP permits the free passage of tools; while when the actuators are in their closed configurations, the BOP seals the through bore against well pressure. This sealing is achieved by the rams meeting, which form a seal with or without a wireline in the through bore. Alternatively, shear/seal rams can be use to shear the wireline before making seal. After the operation is completed, the wireline is extracted from the well and the BOP by transitioning the accuators to their opened configuration until the wireline or tool is removed and transitioning them back to seal off the BOP against the well fluids.

The present invention also broadly relates to a method for preparing a BOP/actuator apparatus of this invention including the step of providing a BOP of this invention including top and bottom fitting, a wireline aperture therethrough, at least one receiving aperture having a channel connector that includes at least one lip or overhang. The method also includes providing an equal number of actuators, one for each receiving aperture, where each actuator includes an actuator connector including at least one flange and at least one recessed region for each lip or overhang so that the actuator connector is disposed within the channel so that the recessed regions align with the lips and the flanges align with the non-lipped portions of the channel. Once aligned, the actuator is rotated so that the flanges slide beneath the lips forming a quick lock connection between the receiving aperture channel connector and the actuator connector.

SPECIFIC EMBODIMENT OF THIS INVENTION

Quick Connection System Having a Single Connection

Referring now of FIGS. 1A-F, a quick connect system, generally 100, for wireline tools. The quick connect system 100 includes a body 102 having an aperture 104 including a female connector 106 shown here with two lips 108*a*&*b*, each having a contacting surface 110. The system 100 also includes an actuator member 112 having a distal end 114 including a male connector 116 shown here with two flanges or lugs 118*a*&*b*, each having a corresponding contacting surface 120. The actuator member 112 is designed to be inserted into the aperture 104 of the body 102 so that the male connector 116 is properly situated in the female connector 106. Once properly situated, the actuator member is rotated by 90° moving the contacting surfaces 110 and 120 into a locking or engaging configuration. Contacting surfaces 110 and 120 for engaging areas 122.

Referring now of FIGS. 1G-L, a quick connect system, generally 150, for wireline tools. The quick connect system 150 includes a body 152 having an aperture 154 including two female connectors 156*a*&*b* shown here each with two lips 158*a*&*b*, each having a contacting surface 160. The system 150 also includes an actuator member 162 having a distal end 164 including two male connectors 166*a*&*b* shown here each including two flanges or lugs 168*a*&*b*, each having a corresponding contacting surface 170. The actuator member 162 is designed to be inserted into the aperture 154 of the body 152 so that the male connector 166 is properly situated in the female connector 156. Once properly situated, the actuator member is rotated by 90° moving the contacting surfaces 160 and 170 into a locking or engaging configuration. Contacting surfaces 160 and 170 for engaging areas 172.

It should be recognized that the number of connectors in not limited to two, but system can include any number depending on designed requirements and to what application the system is intended for use. It should also be recognized that each connection can include connectors having one lug or flange to as many as are practical. While not meaning to be bound by any upper limit, for most application the upper limit is about 12. Of course, as you increase the number of flanges, the amount of rotation to produce a lock decrease. Smaller rotations may be an advantageous property for small sized connection systems or very large and/or heavy connections systems.

Contacting Surfaces May be Angled

Figure 2A:
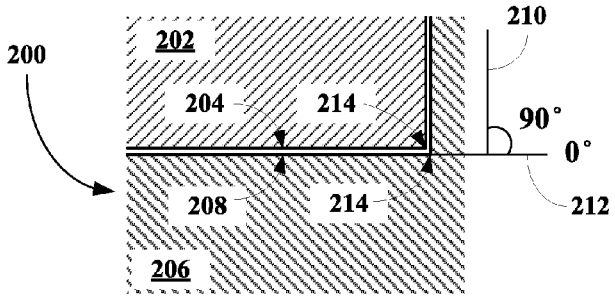
Figure 2C:
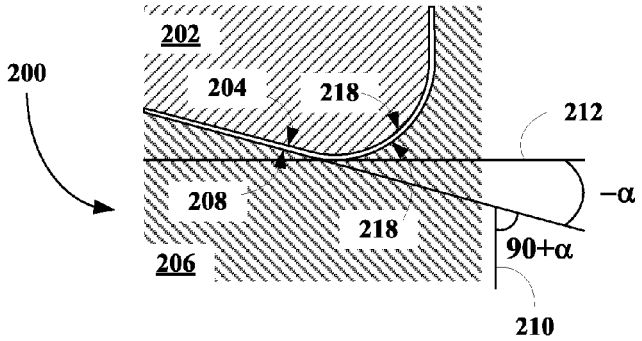

Referring now of FIGS. 2A-C, an expanded views of several embodiments of connections, generally 200, including a lip 202 having a contact surface 204 and a lug 206 having a corresponding contacting surface 208. In the embodiment depicted in FIG. 2A, the contact surfaces 204 and 208 make an angle of 90° relative to a vertical line 210 or 0° relative to a horizontal line 212 and do not have rounded corners, but have sharp corners 214. In the embodiment depicted in FIG. 2B, the contact surfaces 204 and 208 make an angle 90−α relative to a vertical line 210 or α relative to a horizontal line 212 and have rounded corners 216. In FIG. 2C, the contact surfaces 204 and 208 make an angle of 90+α relative to a vertical line 210 or −α relative to a horizontal line 212 and have rounded corners 218. In FIG. 2B, the angled contact surfaces 204 and 208 are angle toward the proximal end of the actuator and away from the wireline throughbore; while in FIG. 2C, the angle contact surfaces 204 and 208 are angles away from the proximal end of the actuator and towards the wireline throughbore. In most embodiments, the angle is between about +40° and about −40°. In other embodiments, the contact surfaces are angled with an angle between about +35° and −35°. In other embodiments, the contact surfaces are angled with an angle between about +30° and −30°

Two Flange Embodiment

Figure 3A:
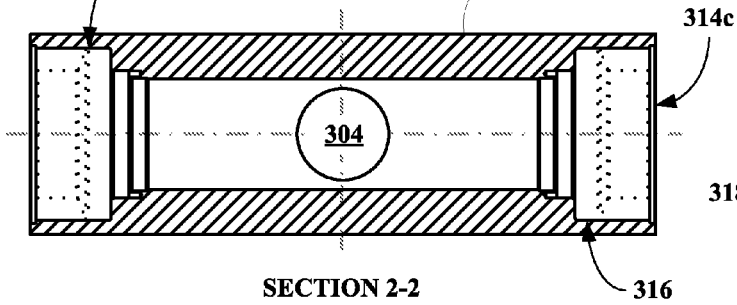
FIGS. 3A-C depict an embodiment of a BOP body of this invention including apertures having a two lipped quick channel connector.
Figure 3B:
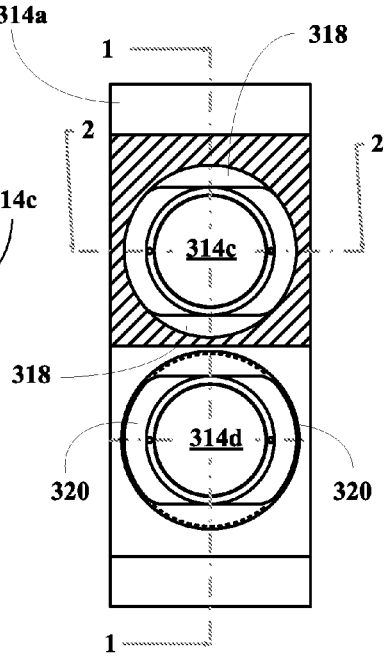
Figure 3C:
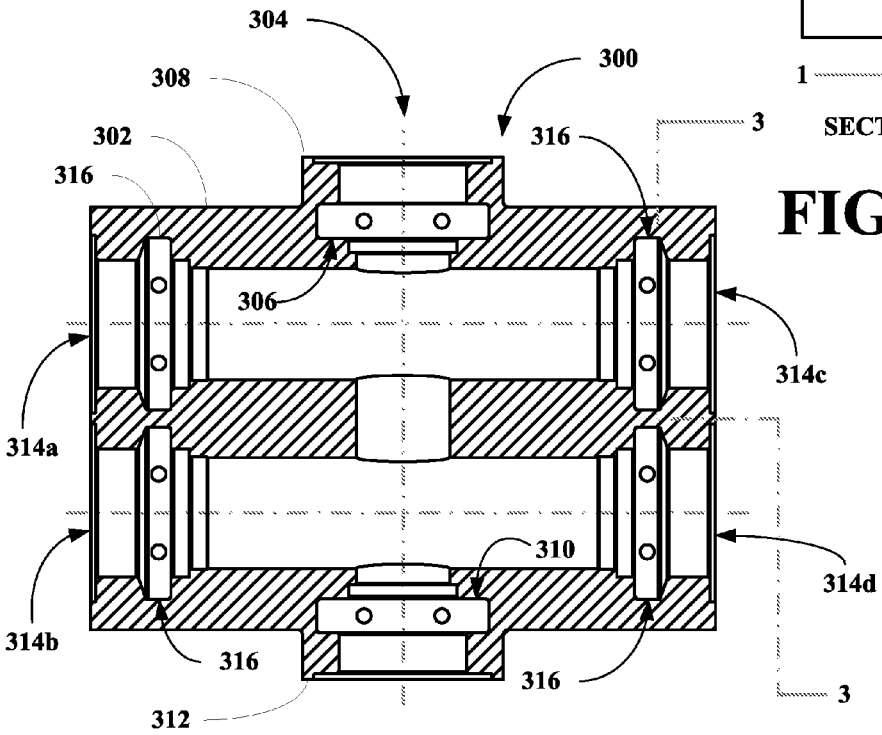
Figures 3D, 3E, 3F, 3G, 3H, 3I:
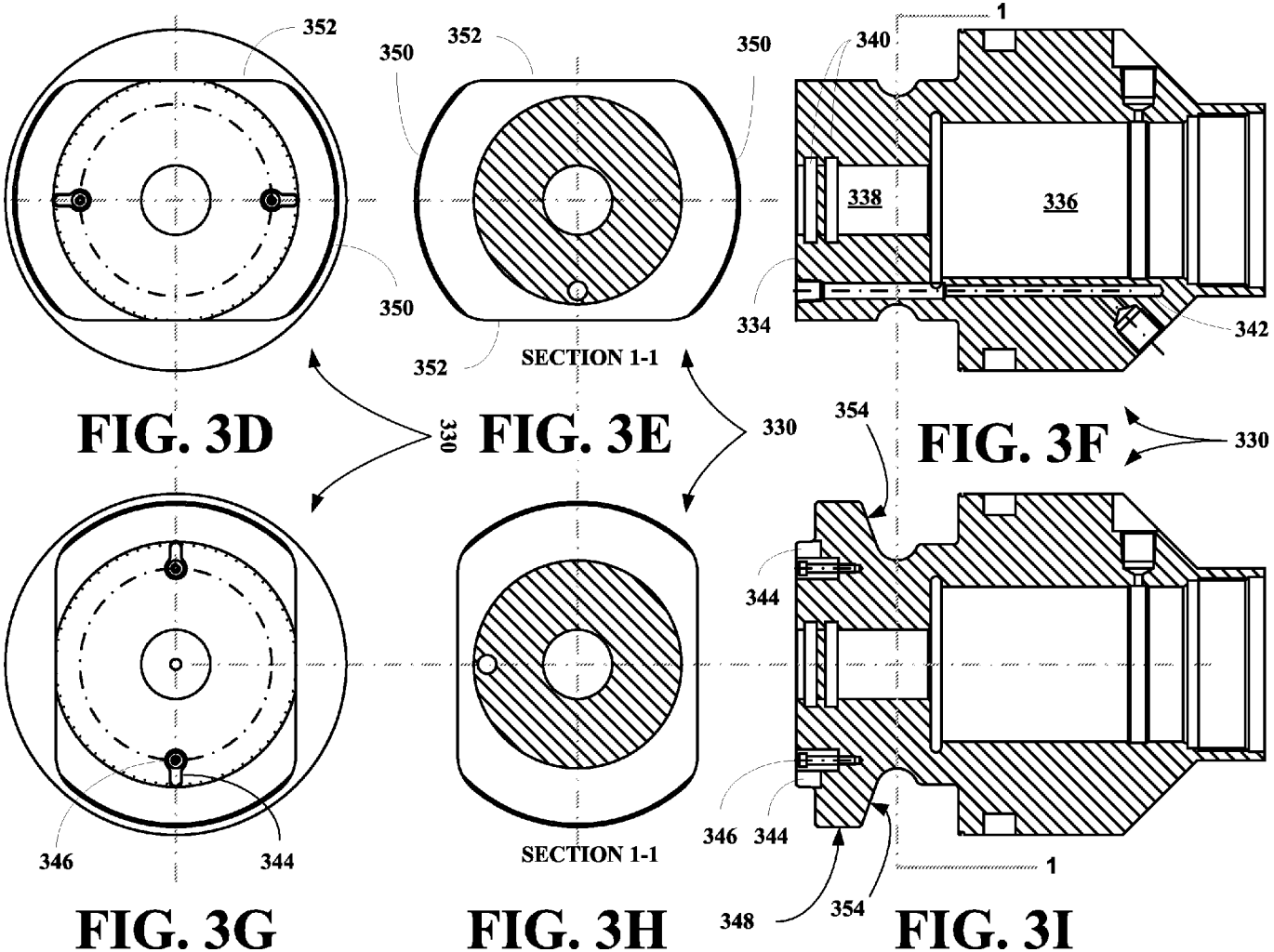
FIGS. 3D-I depict an embodiment of a cylinder portion of an actuator of this invention including a two lug or flanged connector disposed near its distal end.
Figure 3J:
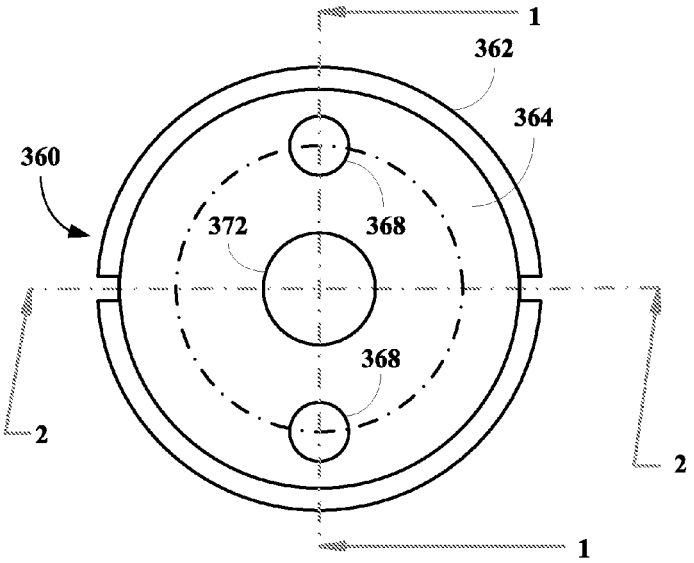
FIGS. 3J-M depict an embodiment of a seal ring of this invention used to align and engage a distal end of a cylinder and a ram.
Figure 3K:
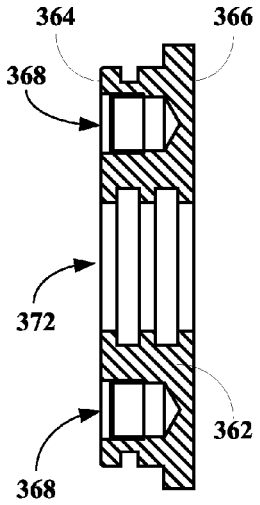
Figure 3L:
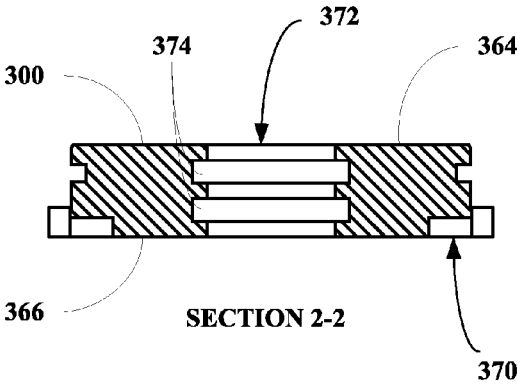
Figure 3M:
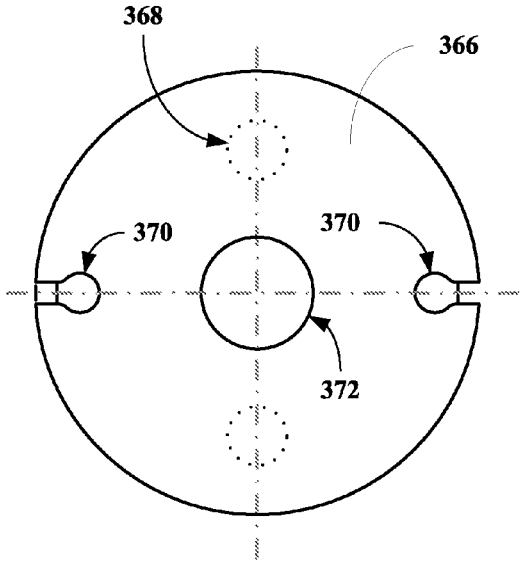

Referring now of FIGS. 3A-C, a two lug embodiment of a new quick connect system for BOPs, generally 300, is shown, where the system requires only the removal of two bolts and rotation of the cylinder until flanges or lugs of a cylinder connector align with non-lipped portions of a receiving aperture connector to release the actuator. The BOP apparatus 300 includes a BOP body 302 having a vertically extending aperture therethrough 304. The apparatus 300 also includes a top fitting 306 at a top 308 of the aperture 304 and a bottom fitting 310 at a bottom 312 of the aperture 304. The body 302 also include two pair of opposing receiving apertures 314*a*&*b* and 314*c*&*d*, each receiving aperture 314*a-d* is adapted to receive an actuator cylinder 330. Each aperture 314*a-d* includes a female connector 316 having two lips 318 and two non-lipped portions 320. In other embodiments, the BOP apparatus can include a single pair of opposing receiving apertures (so called single BOPs) or more than two pairs of opposing receiving apertures, where the additional pairs can have separate features (so called triple or quad BOPs).

Referring now of FIGS. 3D-I, the actuator cylinder 330 is shown to include a top 332 and a bottom 334. The actuator cylinder 330 also includes a hydraulic chamber 336 and a piston fitting 338 having seal grooves 340, where the piston fitting 338 is adapted to receive a piston (not shown) as described below in connection with a four lug quick connect system of this invention. The bottom 334 includes a reduced external diameter 342 adapted to accommodate a telescoping servicing rail as described below in connection with the four lug quick connect system of this invention. The bottom 334 also includes two detent key apertures 344 adapted to receive detent keys 346, where the keys 346 are adapted to align a seal ring (not shown) as described below. The cylinder 330 also includes a male lugged or flanged connector 348 having two flanges or lugs 350 and two recessed areas 352. The male connector 348 is adapted to set within the female connector 316 when an actuator equipped with the cylinder 330 is stabbed into a receiving aperture 314 of the body 302 and rotated by 90° locking the actuator via the cylinder 330 into place as shown in greater detail below. Each lug 350 includes an angled contacting surface 354.

Referring now of FIGS. 3J-M, the apparatus 300 also includes a seal ring/seal plate 360 shown here to include a plate body 362 having a top 364 and a bottom 366. The plate top 364 includes two ram pin apertures 368. The plate bottom 366 includes two detent key apertures 370 adapted to receive the detent keys 344. The detent keys 344 are to align the plate 360 and the cylinder 330. The plate ram rod apertures 368 are adapted to receive ram dowell pins or rods (not shown) aligning the plate 360 and a ram (not shown). The plate 360 also includes a central aperture 372 having two annular seal grooves 374, where the central aperture 372 is adapted to a piston and the seal grooves 374 are adapted to receive seals to seal the piston within the aperture 372.

Figure 3N:
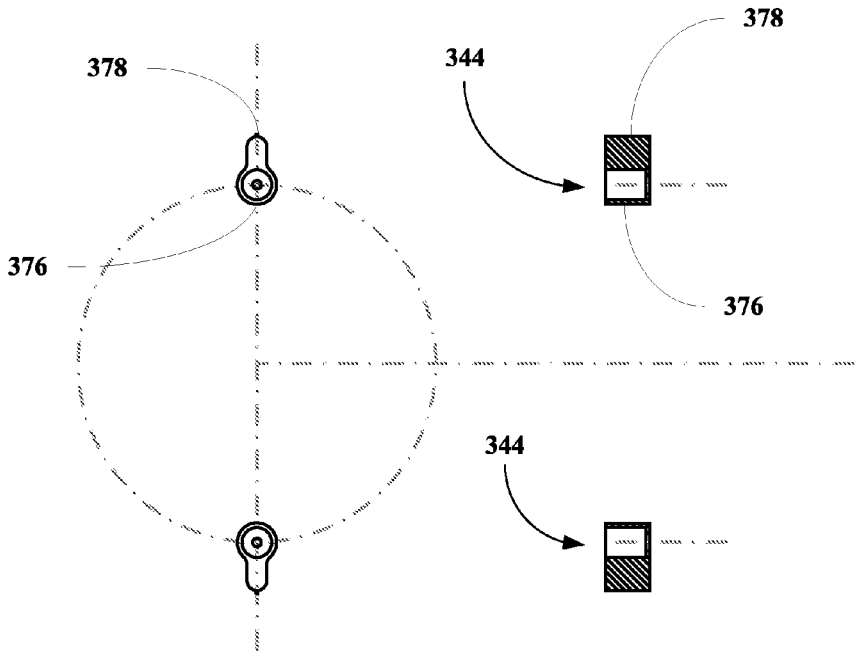
FIG. 3N depicts detent keys used to align the seal plate and cylinder.

Referring now of FIG. 3N, the detent keys 344 are shown in their proper orientation. The keys 344 have a circular end 376 and a rounded elongated end 378 to fit within the detent apertures 370 of the seal plate 360.

Referring now of FIGS. 3O-R, the apparatus 300 is shown in a sequence depicting the insertion of a cylinder/plate assembly 380 including a cylinder 330, a seal plate 360 and detent keys 344 into a receiving aperture 314*c* of the BOP body 302. Looking at FIG. 3O, the apparatus 300 is shown with the spring loaded detent keys 344 forced into the pockets 370 in the seal plate 360. Looking at FIGS. 3P&Q, the assembly 380 is shown inserted into the receiving aperture 314*c* in an unlocked state 382 so that the male connector 348 seats within the channel connector 316. FIGS. 3P&Q also show the dowell pins 384 have both located the seal plate, preventing it from turning and pushed the detent keys 344 into the cylinder 330, i.e., the cylinder 330 can now turn independently from a ram (not shown) and seal plate 360. FIG. 3R shows a cross-section of the connections through the section C, where the cylinder connector is shown seated within the channel connector, before the cylinder is rotated to lock the cylinder in place causing the contacting surfaces to engage. This sequence illustrates the insertion of an actuator into a receiving aperture using the two lug connection system 300 showing proper insertion prior to locking the actuator in place by rotating the cylinder by 90° or proper unlocking for actuator removal or ram servicing.

Figure 3S:
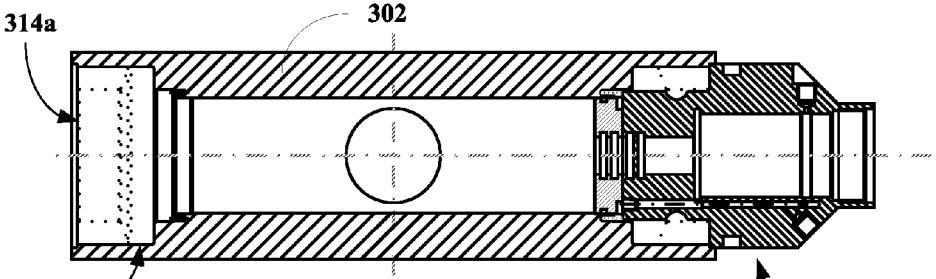
FIGS. 3S-U depict the two lug connecting system of this invention in its locked configuration.
Figure 3T:
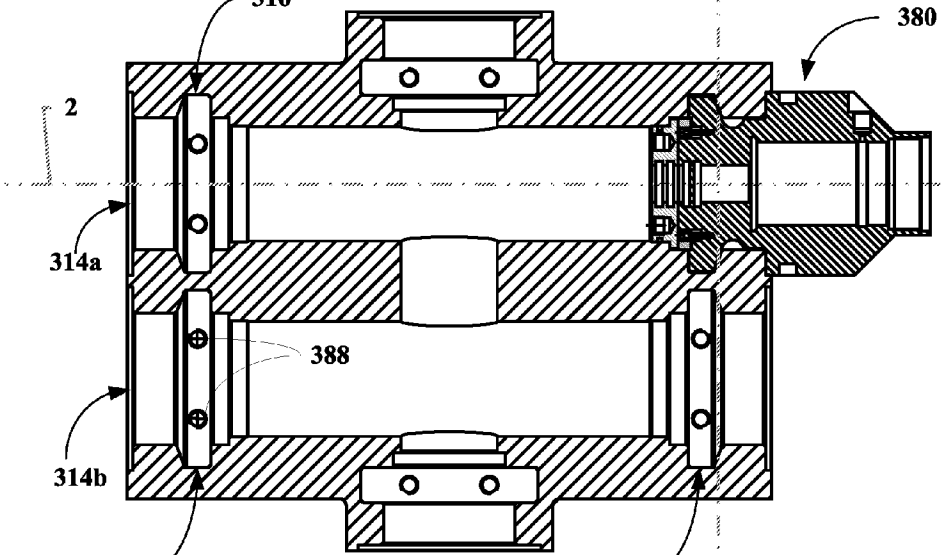
Figure 3U:
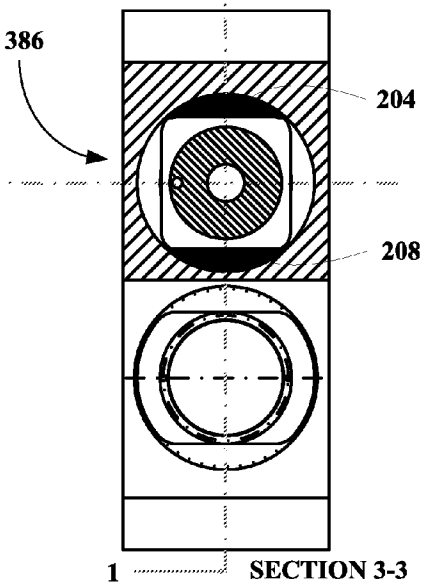

Referring now of FIGS. 3S-U, the apparatus 300 is shown with the assembly 380 in its locked state 386 after the cylinder 330 is rotated with respect to a center line of the aperture 314*c* by 90°. When the cylinder 330 is rotated the flanges 350 engage the lips 318 to lock the actuator in place. The contacting surfaces 204 and 208 are angled and the edges slightly rounded as shown and described in discussion of FIGS. 2A-C above. It should be noted that the ram guide rod holes 368 in the seal plate 360 have not rotated. Once the cylinder 330 is locked in place, screws 388 are tightened onto the lugs 350 to prevent the actuator from rotating during wireline operations.

Four Flange Embodiment

Figure 4A:
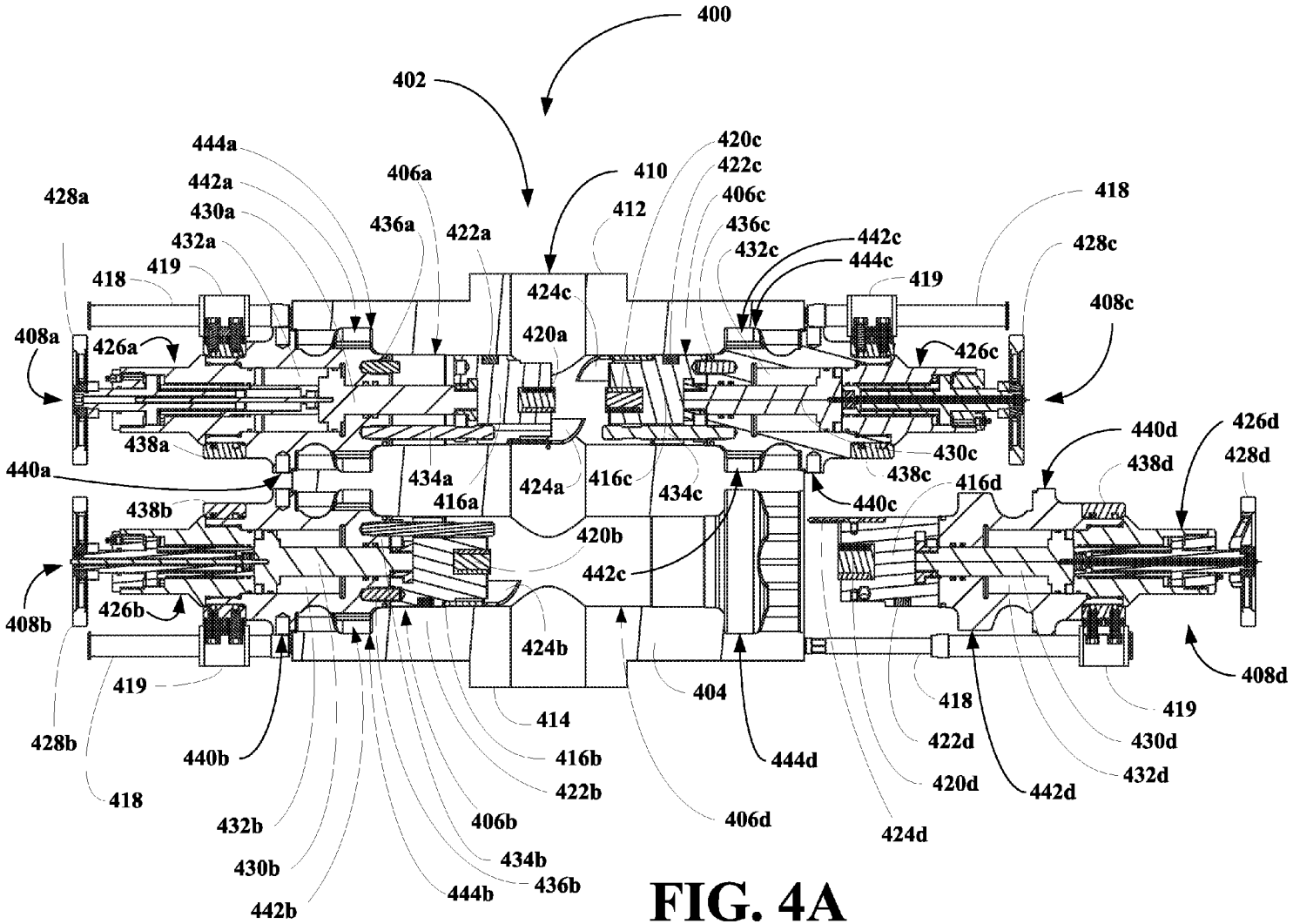
FIG. 4A depicts an embodiment of a BOP apparatus of this invention including a four lug connecting system of this invention with three actuators locked in place and one actuator pulled out of the aperture supported on its telescoping guide rods.

Referring now to FIG. 4A, a quick lock BOP connecting system of this invention, generally 400, is shown to include a blowout preventor (BOP) assembly 402 including a body 404 having two pair of opposing receiving apertures 406*a*&*b* and 406*c*&*d*. The apertures 406*a-d* are adapted to receive corresponding actuator assemblies 408*a-d*.

The BOP assembly 402 also includes a vertically arranged throughbore 410, which is adapted to receive fittings (not shown for wireline or other downhole operation utilizing a BOP apparatus). The wireline BOP assembly 402 is normally placed at a wellhead (not shown) and can be activated to resist blowout of the well. The BOP assembly 402 includes a top fitting (not shown) associated with a top 412 of the throughbore 410 and a bottom fitting (not shown) associated with a bottom 414 of the throughbore 410.

In each receiving aperture 406*a-d*, there is provided its corresponding actuator assembly 408*a-d*. The BOP apparatus 400 also includes rams 3*a*, 3*b*, 3*c* and 3*d*. Each opposing pair of rams 416*a*&*b* and 416*c*&*d* are adapted to be moved between an open configuration and a closed configuration via their associated actuator assemblies 408*a*&*b* and 408*c*&*d*. In FIG. 1A, the actuators 408*a*&*c* and ram 416*a*&*c* are shown in the closed configuration to engage a wireline or other similar downhole equipment; the actuator 408*b* and ram 416*b* and actuator 408*d* and ram 416*d* are shown in the opened configuration to allow the wireline or other similar downhole equipment to be removed or inserted into the BOP apparatus 400 through the vertical throughbore 410; while the actuator 408*d* and ram 416*d* are shown supported on a telescoping support rail 5 sliding through a rail mount 419 so that the ram 416*d* and inner ram seal 7*d* and outer ram seal 9*d* can be easily replaced, where each of the other actuators 408*a-c* also include inner ram seals 420*a-c* and outer ram seals 422*a-c*. The opposing ram pairs 416*a*&*b* and 416*c*&*d* are designed to engage a wireline closing the throughbore 410 about the wireline resisting well fluid. Each ram 416*a-d* includes a wireline guide 11*a-d* adapted to guide the wireline to the center of the ram face.

Each actuator 408*a-d* includes a lead screw assembly 13*a-d*, which is a manual backup for transitioning the rams 416*a-d* from their opened state to their closed state using a manual wheel 15*a-d* of the lead screw assembly 426*a-d*. The lead screw assembly 426*a-d* is also adapted as a fail safe if the hydraulic system fails. The hydraulic system is used to transition a piston 17*a-d* of the actuator assemblies 408*a-d* via a hydraulic chamber 19*a-d*. Each actuator assembly 408*a-d* also includes a ram guide rod 21*a-d* (434*d* is not shown) and a ram drive pin 23*a-d* (436*d* is not shown). Each actuator assembly 408*a-d* also includes a bearing ring 25*a-d* adapted to permit actuator cylinders 27*a-d* to be rotated relative to the BOP body 404 so that four lugged connectors 29*a-d* of the actuator assemblies cylinders 440*a-d* can lockingly engage corresponding channel connectors 31*a-d* of the apertures 406*a-d*.

Figures 4B, 4C:
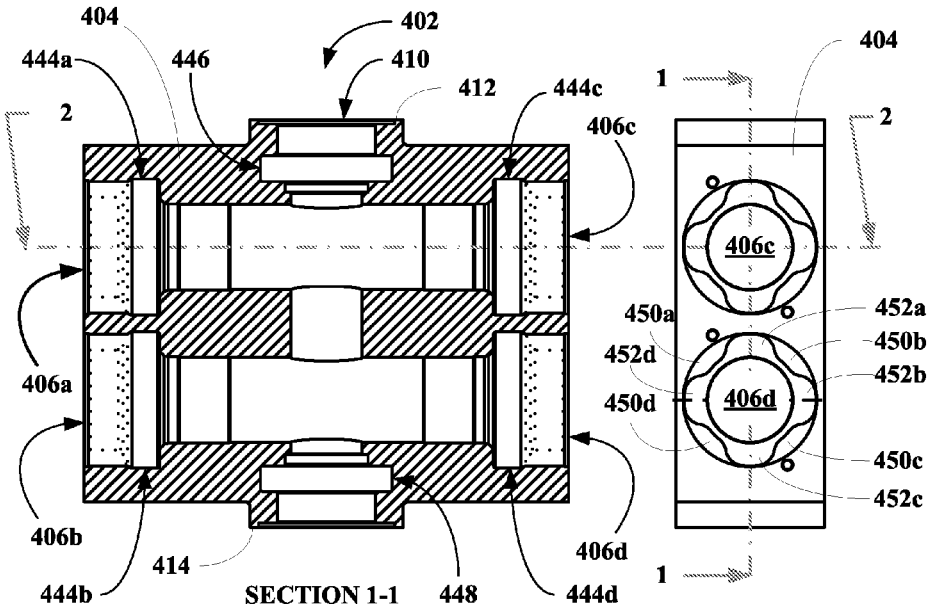
FIGS. 4B-D depict the BOP body of the apparatus of FIG. 4A.
Figure 4D:
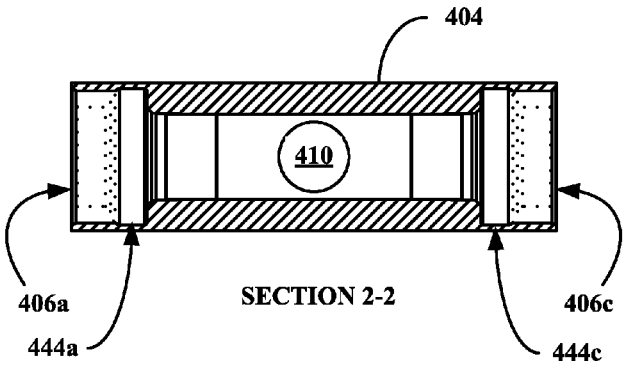
Figure 4E:
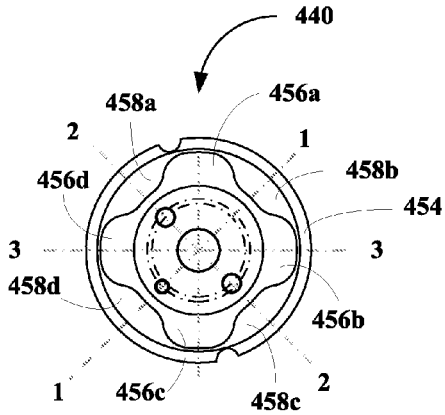
FIGS. 4E-H depict the actuator cylinders of the apparatus of FIG. 4A.
Figure 4F:
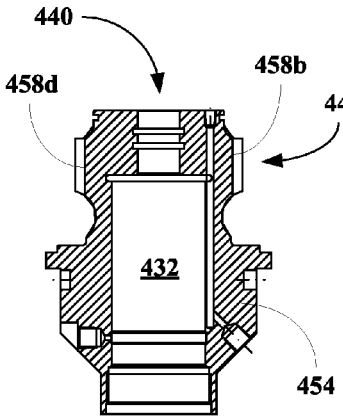
Figure 4H:
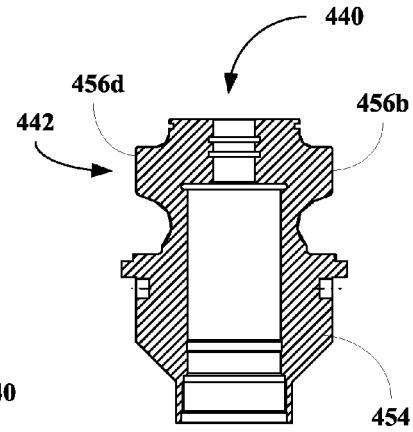
Figure 4G:
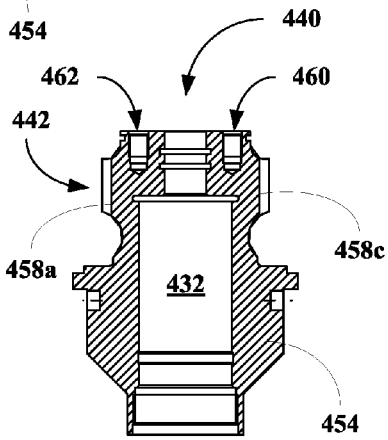

Referring now to FIGS. 4B-D, the BOP body 402 is shown in greater detail. The BOP assembly 402 includes the body 404. The body 404 including the vertical aperture 410 with a top fitting 446 at the top 412 and a bottom fitting 448 at the bottom 414. The body 404 includes the four receiving apertures 406*a-d* having their associated channel connectors 444*a-d*. Each channel connector 444*a-d* include four lips 450*a-d* and four non-lipped portions 452*a-d*.

Referring now to FIGS. 4E-H, one of the actuator cylinders 440 is shown in greater detail. Each cylinder 440 includes a body 454 and a lugged connector 442. Each connector 442 includes four lugs 456*a-d* and four recessing regions 458*a-d*, each recessed region 458*a*, 458*b*, 458*c* or 458*d* separates one of the lugs 456*a-d*. The cylinder 440 also includes a drive pin aperture 460 and a ram guide aperture 462.

FIGS. 4I-L illustrates the process of stabbing an actuator cylinder 440*c* into its receiving aperture 406*c* and seating the connectors 442*c* in the channel connector 444*c* in its unlocked configuration 464, where the lugs 456*a-d* of the lugged connector 442*c* are situated in the non-lipped portion 452*a-d* of the channel connector 444*c*. It should be noted that the ram guide rod and drive in holes shown in FIG. 4I are oriented at an angle to the vertical axis of the body 402.

FIGS. 4M-O illustrates the process of locking the actuator cylinder 440*c* into its locked configuration 466 by rotating the cylinder 440*c* by 45° so that the lugs 456*a-d* of the lugged connector 442*c* are situated under the lipped portion 450*a-d* of the channel connector 444*c*, where the contacting surfaces 204 and 208 engage shown here angled with rounded edges. It should be noted that the ram guide rod and drive pin holes have now aligned with the vertical axis of the BOP body 402 as has the rams 416*a-d* due to the alignment of the ram drive pins. It should be noted that the ram guide rod and drive pin holes are oriented at an angle to the vertical axis of the body 402.

Figure 5A:
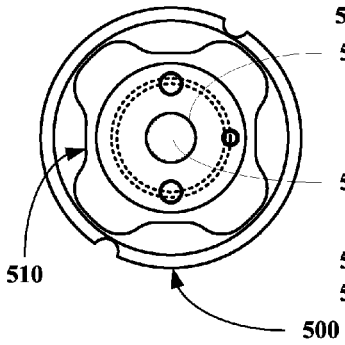
FIGS. 5A&B depict an actuator assembly of this invention including a conventional piston rod seal arrangement, where the seals are housed directly in the cylinder body.
Figure 5B:
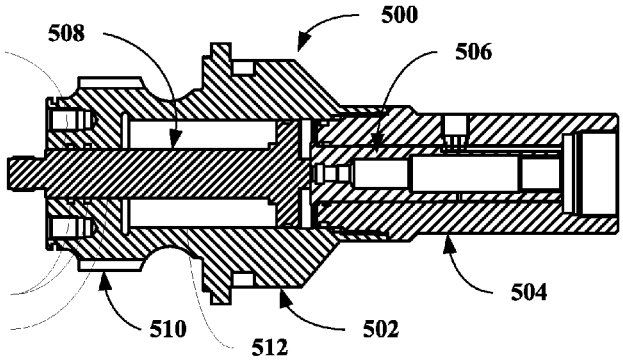
FIGS. 5C&D depict an actuator assembly of this invention including a new piston rod seal arrangement, where the seals are housed in removable cartridge insert.

Referring now to FIGS. 5A&B, an actuator apparatus of this invention, generally 500, including a conventional piston rod seal arrangement is shown. The apparatus 500 includes a cylinder 502, a cylinder cap 504, a keyed stem 506 and a piston rod 508. The cylinder 502 includes a four lug connector 510 of this invention. The piston rod 508 is disposed partly in a hydraulic chamber 512 and partly in a sealing aperture 514. The sealing aperture 512 includes two seal grooves 516 disposed on an inner surface 518 of the grooves 516 adapted to receive piston rod seals (not shown) such as o-rings. The seals are therefore housed directly in the cylinder 502 of an actuator 500. This conventional seal arrangement with the piston rod seals housed directly in the cylinder are difficult to maintain and seal replacement is difficult as well. To replace the seals in such an actuator 500, the actuator cylinder 502 must be completely drained and the piston 508 removed before the piston rod seals can be removed and replaced. Although the piston rod seals are generally O-rings, the same process must be followed regardless of the nature of the seals, which can be any other so-called "lip" seal means.

Figure 5C:
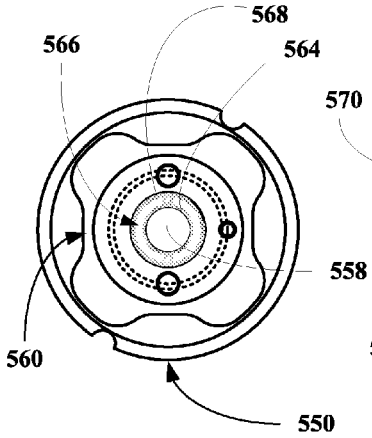
Figure 5D:
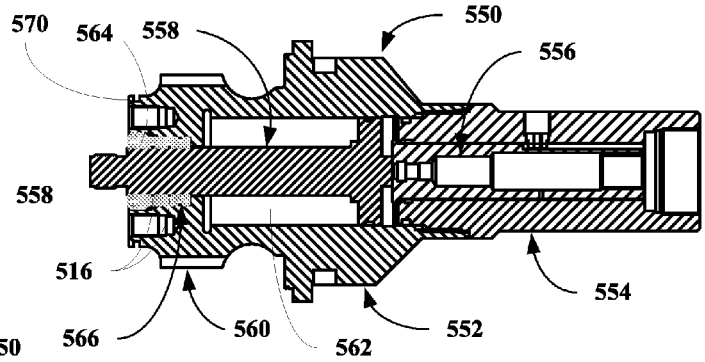

Referring now to FIGS. 5C&D, an actuator apparatus of this invention, generally 550, including a new removable piston rod seal cartridge of this invention is shown. The apparatus 500 includes a cylinder 552, a cylinder cap 554, a keyed stem 556 and a piston rod 558. The cylinder 552 includes a four lug connector 560 of this invention. The piston rod 558 is disposed partly in a hydraulic chamber 562 and partly in a sealing aperture 564. Instead of the piston rod seals being housed directly in the cylinder 552 of the actuator 550 as is the case with the actuator 500 of FIGS. 5A&B, the piston rod seals are housed in a removable cartridge 566 that is fitted and locked into a seal cartridge aperture 568 in a distal end 570 of the actuator cylinder 552 of an actuator 550. In the embodiment depicted in FIGS. 5C&D, the cartridge 566 is threaded at its proximal end and the aperture 568 is threaded so that the cartridge 566 is installed by simply screwing it into the aperture 568 and removed by simply unscrewing it from the aperture 568.

The cartridges 566 of this invention are adapted to allow seal replacement in a more straight forward and easier method than is possible with conventional actuators. Here all that is required is that the actuator be pulled to expose the ram and ram end of the actuator cylinder. The rams are then removed to exposed the ram end of the actuator cylinder. Once the ram end of the actuator cylinder is exposed, the cartridge can be removed, and a new cartridge inserted. Of course, the method can also include the step of cleaning the cartridge aperture prior to inserting the new cartridge. Once the cartridge is replaced, the rams are reset and the actuator is then reinserted into the BOP for continued BOP operations.

Figure 6A:
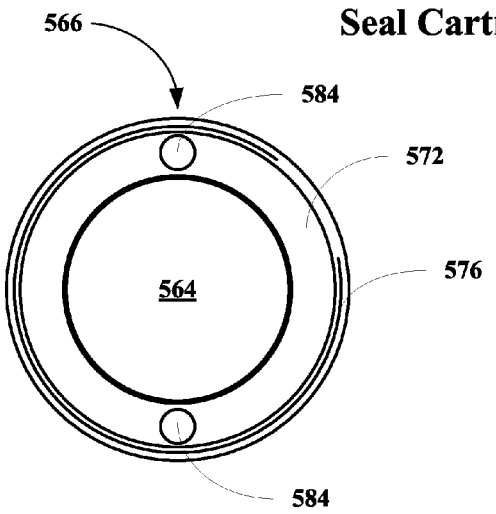
FIGS. 6A&B depict expanded views of an embodiment of a seal cartridge of this invention.
Figure 6B:
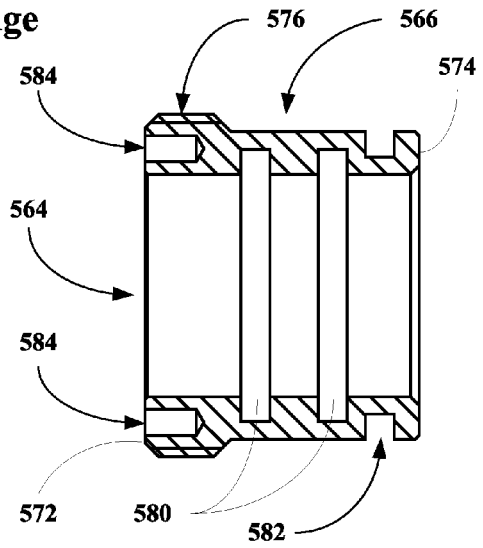
FIG. 6C depicts an actuator assembly of this invention including a seal cartridge aperture in its distal end.
Figure 6C:
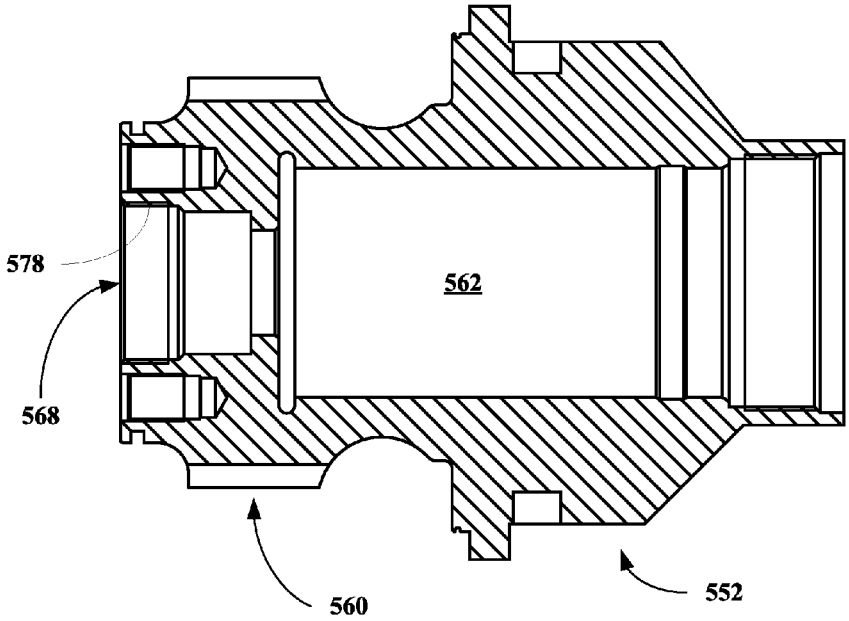

Referring now to FIGS. 6A&B, two expanded views of the cartridge 566 is shown removed from the actuator 550. The cartridge 566 includes a proximal end 572 and a distal end 574. The proximal end 572 includes a threaded connector 576 designed to be threaded into a corresponding thread connector 578 of the aperture 568 a shown in FIG. 6C. The cartridge 566 includes the seal grooves 580 adapted to receive the seals (not shown). The cartridge also includes a distal grove 582 adapted to receive a seal (not shown). As stated above, the seals are generally O-rings, but can be any other seal means used in the art. The cartridge 566 also includes proximal aperture 584 adapted to assist an operator in installing and removing the cartridge 566.

While, the embodiment of FIGS. 5C&D and 6A-C utilized threaded connections for inserting and locking the cartridge 566 into the aperture 568, the cartridge 566 can include a connector is similar to the flange connector of the actuators of this invention having a profile of lugs or flanges that is designed to match a connector disposed in the aperture 568. The connector 578 in the aperture 568 would of course include lipped and non-lipped connector designed to accommodate the flanged connector. In other embodiment, the cartridge 566 can be locked using bolts that go through a flange of the cartridge and thread into the cylinder 552 of the actuator 550. While several cartridge locking arrangements have been described, one of ordinary skill in the art should recognize that any locking means can be used to hold the cartridge 566 in the aperture 568, provided that the means is capable of holding the cartridge in place during standard BOP operations.

Figure 7A:
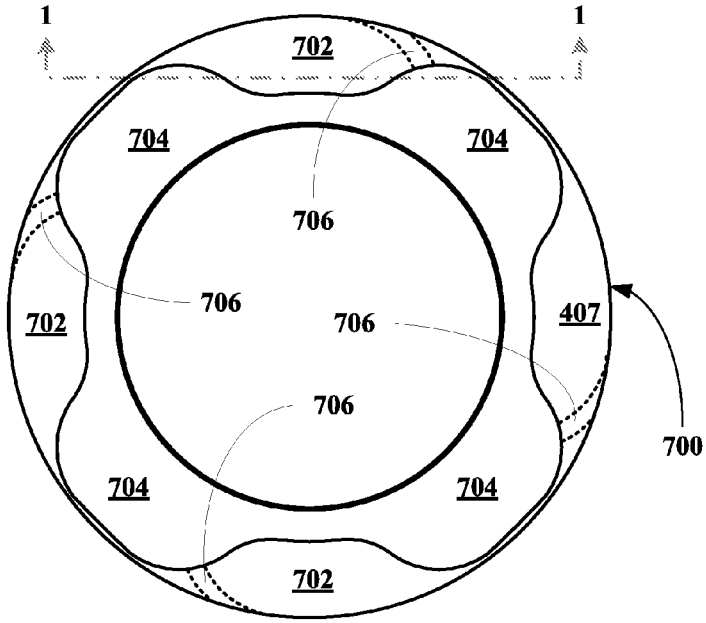
FIGS. 7A-D depict different embodiments of rotational stops disposed in the channel connector at the lips.
Figure 7B:
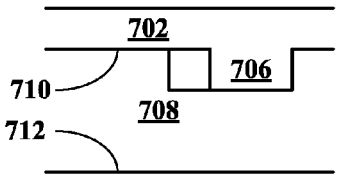

Referring now to FIGS. 7A&B, an embodiment of the receiving aperture connector with at least one rotational stop, generally 700, is shown to include four lips 702, four non-lipped regions 704 and four lug stops 706 extending into an interior 708 of the connector 700. The stops 706 are adapted to stop the rotation of the lug connector of the actuators of this invention when the quick connection is fully engaged and permits the lug connector to only be rotated in one direction. Although FIGS. 7A&B are shown to include four stops 706, the apparatus can include from one to four stops 706.

Figure 7C:
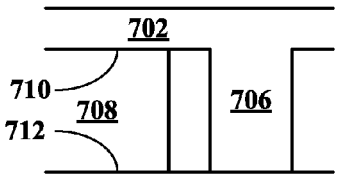

Referring now to FIG. 7C, another embodiment of the stops 706 is shown, where the stops 706 extend from a top 710 to a bottom 712 of the channel connector 700. In this embodiment, the stops 706 may include one or a plurality of apertures to permit gases or fluid to escape as the actuator is being rotated into its locked configuration in the channel connector of the BOP body.

Figure 7D:
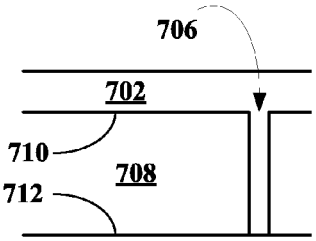

Referring now to FIG. 7D, another embodiment of the stops 706 is shown, where the stops 706 comprise one or more rods extending from the top 710 of the channel 700 to the bottom 712 of the channel disposed on the same end of the lips so that the lugs will engage the stops after being rotated through its rotation locking angle.

Figure 8A:
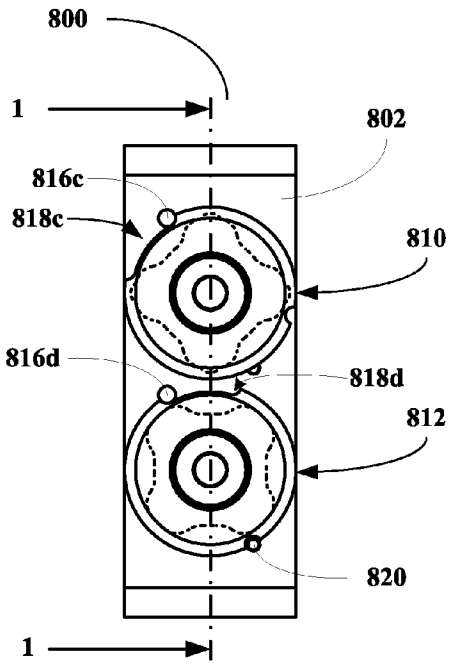
FIGS. 8A&B depict another embodiment of rotational stops of this invention and rotational locks.
Figure 8B:
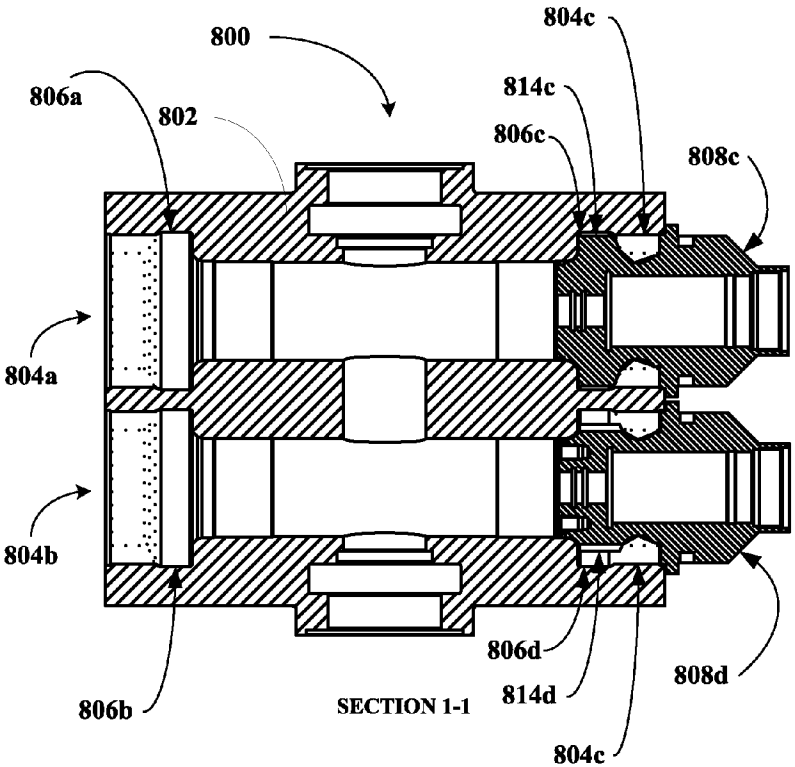

Referring now to FIGS. 8A&B, another embodiment of an apparatus of this invention including a rotational stop, generally 800, is shown to include a BOP body 802 having four receiving apertures 804*a-d*, each including a four lipped connectors 806*a-d*. Two of the apertures 804*c-d* include actuator cylinders 808*c*&*d* inserted into the apertures 804*c*&*d*, one shown in the unlocked state 810 and one shown in the locked state 812. Each of the two actuator cylinders 808*c*&*d* include four lugged connectors 814*c*&*d*. The apparatus 800 also includes stop pins 816*c*&*d* and pin grooves 818*c*&*d* which allow the actuator cylinders 808 to be rotated and stopped when the lips and lugs are in full contact in the locked configuration 812*d*. The apparatus 800 also shows an anti-rotation lock bolt 820 having been fitted in place in the locked configuration 812.

Alternatively, the actuator distal end can includes one or more biased pins that become flush with the distal end when the actuator is in its unlocked configuration. The channel would have a graded, arcuate or curvi-linear slot disposed in its bottom surface being prior to where the actuator lugs would rest in their locked configuration. The slot starts at its proximal substantially flush with the bottom surface and gradually deepens in its progress towards the lug locked location, where the slot terminates at its distal end in a wall of sufficient height to stop further rotation of the actuator. The stop is caused by the biased pins extending into the slot and then encountering the wall. It should be recognized that any other stopping means can be used as well; provided that the stopping means does not interfere with BOP operations and does not interfere with actuator removal.

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

We claim:

1. A quick connect pressure manifold apparatus comprising:

a body including:

at least one actuator receiving aperture;

at least one actuator, one of the at least one actuators for each of the at least one actuator receiving apertures, where the actuators include:

a cylinder, a ram assembly disposed on a distal end of the cylinder, a ram transition assembly, where the ram transition assembly transitions the ram assembly between an opened configuration and a closed configuration, a quick connection system including:

at least one female connector, wherein each of the at least one female connectors includes a female engaging profile and wherein the female engaging profile of each of the at least one female connectors is disposed in each of the at least one actuator receiving apertures, at least one male connector, wherein each of the at least one male connectors corresponds to one of the at least one female connectors, wherein each of the at least one male connectors includes a male engaging profile, and wherein the male engaging profile of each of the at least one male connectors is disposed on an outer surface of each of the actuator cylinders of each of the at least one actuators, where the female profile includes between 1 and about 20 lips and non-lipped regions in an alternating configuration and wherein the male profile includes an equal number of lugs and recessed regions and where one of the male engaging profiles registers with one of the female engaging profiles upon insertion of one of the at least one actuators into one of the at least one actuator receiving apertures and upon rotation of the at least one the actuator through a rotational angle, the male profile engages the female profile in at least one contacting zone, and where the rotational angle depends on the profiles.

2. The apparatus of claim 1, wherein the contacting zone are angled with respect to an axis perpendicular to a longitudinal axis of the receiving aperture by a contact angle.

3. The apparatus of claim 2, wherein the contact angle is between about −40° and about +40°.

4. The apparatus of claim 2, wherein the contact angle is between about −30° and about +30°.

5. The apparatus of claim 2, wherein the contact angle is between about −40° and about −20° or between about +20° and about +40°.

6. The apparatus of claim 1, wherein the female and the male profiles are symmetrical or non-symmetrical disposed about a longitudinal axis of the actuator.

7. The apparatus of claim 1, wherein the quick connecting system further includes:

a rotational stop adapted to permit rotation only in one direction and to stop rotation after the actuator is rotated through a rotational angle, and a rotation block adapted to prevent the actuator from rotating after the actuator has been rotated into a locked configuration.

8. The apparatus of claim 1, wherein the body further includes:

at least one pair of receiving apertures disposed on opposing sides of the body.

9. The apparatus of claim 1, wherein the ram assembly comprises:

drive pins disposed on a distal end of the cylinder, a ram disposed on a distal end of the cylinder including drive pin apertures, where the drive pins orient the ram relative to the cylinder and permit the ram assembly to rotate with the cylinder.

10. The apparatus of claim 1, wherein the ram assembly comprises:

a seal plate disposed on a distal end of the cylinder and including:

detent keys disposed on the distal end of the cylinder, where the keys are adapted to engage detent key apertures in a proximal end of the seal plate, ram guide rod apertures disposed on a distal end of the seal plate, and ram guide rods disposed in the guide rod apertures, and a ram disposed on a distal end of the plate including ram guide rod apertures adapted to receive the ram guide rods orienting the ram and the plate, where the seal plate is adapted to permit the seal plate and ram to rotate relative to the cylinder.

11. The apparatus of claim 1, wherein the body further comprises:

a throughbore having a top including a top fitting, where the top fitting is adapted to attach the body to pressure equipment, and a bottom including a bottom fitting, where the bottom fitting is adapted to attached the body to a pressurized assembly.

12. The apparatus of claim 1, wherein each actuator receiving aperture is oriented substantially perpendicular to the throughbore.

13. The apparatus of claim 1, wherein ram transition assembly comprises a hydraulic assembly including:

a piston rod, a hydraulic chamber, and flow paths adapted to supply an hydraulic fluid to the chamber to transition the piston rod between an opened configuration and a closed configuration, which transitions the ram between an opened configuration and a closed configuration.

14. The apparatus of claim 13, further comprising:

a lead screw assembly adapted to act as a backup to the hydraulic assembly to hold the ram in a closed configuration and to allow manual transition of the ram from an opened configuration to a closed configuration.

15. The apparatus of claim 13, wherein each actuator further includes:

a cartridge aperture disposed in the distal end of the cylinder, and including:

a proximal end the opens onto the chamber, a distal end flush with the distal end of the cylinder and a cartridge aperture connector disposed in an interior surface near a distal end a piston rod seal cartridge including:

a proximal end, a distal end, an aperture therethrough, at least one seal groove disposed in the aperture, each groove adapted to receive a piston rod seals, a cartridge connector disposed on an exterior surface of the cartridge near a proximal end adapted to lockingly engage the cartridge aperture connector, and at least one exterior seal grove disposed on the exterior surface of the cartridge towards a distal end and adapted to receive a seal to seal the cartridge against the cartridge aperture.

16. The apparatus of claim 1, wherein ram transition assembly comprises a lead screw assembly adapted to allow direct manual transition of the ram between a closed configuration and a opened configuration or visa-versa.

17. A method for blowout preventor operations comprising the steps of:

providing a blowout preventor (BOP) apparatus comprising:

a body including:

at least one actuator receiving aperture;

a throughbore having a throughbore having a top including a top fitting, where the top fitting is adapted to attach the body to pressure equipment, and a bottom including a bottom fitting, where the bottom fitting is adapted to attached the body to a pressurized assembly, at least one actuator, one of the at least one actuators for each of the at least one actuator receiving apertures, where the actuators include:

a cylinder, a ram assembly disposed on a distal end of the cylinder, a ram transition assembly adapted to transition the ram assembly between an opened configuration and a closed configuration, a quick connection system including:

at least one female connector, where each of the at least one female connectors includes a female engaging profile and where the female engaging profile of each of the at least one female connectors is disposed in each of the at least one actuator receiving apertures, and where the female engaging profile comprises alternating lipped and non-lipped regions, at least one male connector, where each of the at least one male connectors corresponds to one of the at least one female connectors, where each of the at least one male connectors includes a male engaging profile, and where the male engaging profile of each of the at least one male connectors is disposed on an outer surface of each of the actuator cylinders, where the male engaging profile comprises lugs and recesses corresponding to the lipped and non-lipped regions of the at least one female connector, where one of the male engaging profiles registers with one of the female engaging profiles upon insertion of one of the at least one actuators into one of the at least one receiving apertures and upon rotation of the at least one actuator through a rotational angle, the male profile engages the female profile in at least one contacting zone, and where the rotational angle depends on the profiles, connecting the BOP apparatus at a bottom fitting to a wellhead, connecting the BOP apparatus at a top fitting to an insertion assembly, opening the well, opening the rams, inserting a downhole assembly into the throughbore of the BOP apparatus, inserting the downhole assembly into the well, withdrawing the downhole assembly from the well into the BOP apparatus, removing the downhole assembly from the BOP apparatus into the insertion assembly, closing the rams, and closing the well.

18. The method of claim 17, further comprising the steps:

prior to the withdrawing step, rotating an actuator through the rotation angle in a direction opposite of a locking direction to unlock the actuator, pulling the actuator out of the body on a telescoping support rail, and replacing the ram or ram seals.

19. The method of claim 17, wherein the ram transition assembly comprises a hydraulic assembly including:

a piston rod, a hydraulic chamber, and flow paths adapted to supply an hydraulic fluid to the chamber to transition the piston rod between an opened configuration and a closed configuration, which transitions the ram between an opened configuration and a closed configuration.

20. The method of claim 19, wherein each actuator further include:

a cartridge aperture disposed in the distal end of the cylinder, and including:

a proximal end the opens onto the chamber, a distal end flush with the distal end of the cylinder and a cartridge aperture connector disposed in an interior surface near a distal end a piston rod seal cartridge including:

a proximal end, a distal end, an aperture therethrough, at least one seal groove disposed in the aperture, each groove adapted to receive a piston rod seals, a cartridge connector disposed on an exterior surface of the cartridge near a proximal end adapted to lockingly engage the cartridge aperture connector, and at least one exterior seal grove disposed on the exterior surface of the cartridge towards a distal end and adapted to receive a seal to seal the cartridge against the cartridge aperture.

21. The method of claim 20, further comprising the steps of:

prior to the withdrawing step, rotating an actuator through the rotation angle in a direction opposite of a locking direction to unlock the actuator, pulling the actuator out of the body on a telescoping support rail, removing the ram, removing the seal cartridge, inserting a new seal cartridge, and replacing the ram.

22. The method of claim 17, wherein the contacting zone are angled with respect to an axis perpendicular to a longitudinal axis of the receiving aperture by a contact angle.

23. The apparatus of claim 22, wherein the contact angle is between about −40° and about +40°.

24. The method of claim 22, wherein the contact angle is between about −30° and about +30°.

25. The method of claim 17, wherein the female profile includes between 1 and about 20 lips and non-lipped regions in an alternating configuration and wherein the male profile includes an equal number of lugs and recessed regions.

26. The method of claim 17, wherein the female and the male profiles are symmetrical or non-symmetrical disposed about a longitudinal axis of the actuator.

27. The method of claim 17, wherein the quick connecting system further includes:

a rotational stop adapted to permit rotation only in one direction and to stop rotation after the actuator is rotated through a rotational angle, and a rotation block adapted to prevent the actuator from rotating after the actuator has been rotated into a locked configuration.

28. The method of claim 17, wherein the body further includes:

at least one pair of receiving apertures disposed on opposing sides of the body.

29. The method of claim 17, wherein the ram assembly comprises:

drive pins disposed on a distal end of the cylinder a ram disposed on a distal end of the cylinder including drive pin apertures, where the drive pins orient the ram relative to the cylinder and permit the ram assembly to rotate with the cylinder without changing the ram orientation.

30. The method of claim 17, wherein the ram assembly comprises:

a seal plate disposed on a distal end of the cylinder and including:

detent keys disposed on the distal end of the cylinder, where the keys are adapted to engage detent key apertures in a proximal end of the seal plate, ram guide rod apertures disposed on a distal end of the seal plate, and ram guide rods disposed in the guide rod apertures, and a ram disposed on a distal end of the plate including ram guide rod apertures adapted to receive the ram guide rods orienting the ram and the plate, where the seal plate is adapted to permit the seal plate and ram to rotate relative to the cylinder.

31. The method of claim 17, wherein each actuator receiving aperture is oriented substantially perpendicular to the throughbore.

32. A method of assemblying a blowout preventor apparatus comprising the steps of:

providing blowout preventor (BOP) apparatus comprising:

a body comprising:

at least one actuator receiving aperture at least one actuator, one of the at least one actuators for each of the at least one actuator receiving apertures, where the actuators includes:

a cylinder, a ram assembly disposed on a distal end of the cylinder, a ram transition assembly adapted to transition the ram between an opened configuration and a closed configuration, a quick connection system including:

at least one female connector, each female connector having a female engaging profile, disposed in each actuator receiving aperture, at least one male connector, one for each female connector, each male connector having a male engaging profile, disposed on an outer surface of an actuator cylinder, where the male engaging profile is adapted to register with the female engaging profile upon insertion of an actuator into a corresponding receiving aperture and upon rotation of the actuator through a rotational angle, the male profile engages the female profile in at least one contacting zone, and where the rotational angle depends on the profiles, inserting or stabbing an actuator into a receiving aperture so that the male connector seats in the female connector, after insertion, rotating the actuator so that the male profile engages the female profile in at least one contacting zone, and transitioning the ram assemblies to the closed configuration.

33. The method of claim 32, wherein the contacting zone are angled with respect to an axis perpendicular to a longitudinal axis of the receiving aperture by a contact angle.

34. The method of claim 33, wherein the contact angle is between about −40° and about +40°.

35. The method of claim 33, wherein the contact angle is between about −30° and about +30°.

36. The method of claim 32, wherein the female profile includes between 1 and about 20 lips and non-lipped regions in an alternating configuration and wherein the male profile includes an equal number of lugs and recessed regions.

37. The method of claim 32, wherein the female and the male profiles are symmetrical or non-symmetrical disposed about a longitudinal axis of the actuator.

38. The method of claim 32, wherein the quick connecting system further includes:

a rotational stop adapted to permit rotation only in one direction and to stop rotation after the actuator is rotated through a rotational angle, and a rotation block adapted to prevent the actuator from rotating after the actuator has been rotated into a locked configuration.

39. The method of claim 32, the BOP apparatus further comprises:

one pair of opposing receiving apertures.

40. The method of claim 32, wherein the ram assembly comprises:

drive pins disposed on a distal end of the cylinder a ram disposed on a distal end of the cylinder including drive pin apertures, where the drive pins orient the ram relative to the cylinder and permit the ram assembly to rotate with the cylinder without changing the ram orientation.

41. The method of claim 32, wherein the ram assembly comprises:

a seal plate disposed on a distal end of the cylinder and including:

detent keys disposed on the distal end of the cylinder, where the keys are adapted to engage detent key apertures in a proximal end of the seal plate, ram guide rod apertures disposed on a distal end of the seal plate, and ram guide rods disposed in the guide rod apertures, and a ram disposed on a distal end of the plate including ram guide rod apertures adapted to receive the ram guide rods orienting the ram and the plate, where the seal plate is adapted to permit the seal plate and ram cylinder to rotate relative to the cylinder.

42. The method of claim 32, wherein the body further comprises:

a throughbore having a top including a top fitting, where the top fitting is adapted to attach the body to a pressure assembly, and a bottom including a bottom fitting, where the bottom fitting is adapted to attached the body to a pressurized assembly.

43. The method of claim 32, wherein each actuator receiving aperture is oriented substantially perpendicular to the throughbore.

44. The method of claim 32, wherein the ram transition assembly comprises a hydraulic assembly including:

a piston rod, a hydraulic chamber, and flow paths adapted to supply an hydraulic fluid to the chamber to transition the piston rod between an opened configuration and a closed configuration, which transitions the ram between an opened configuration and a closed configuration.

45. A blowout preventor assembly comprising:

a body having at least one actuator receiving aperture;

an actuator for each of the at least one actuator receiving apertures, wherein each actuator further comprises:

a cylinder;

a ram assembly coupled to an end of the cylinder; and a ram transition assembly adapted to transition the ram between an opened configuration and a closed configuration in response to actuation by a ram assembly actuator; and a quick lock mechanism adapted to secure each actuator in a corresponding receiving aperture, where the mechanism comprises female connectors, disposed in the receiving apertures, and having alternating lipped and non-lipped regions and male connectors, disposed on an outer surface of each of the actuator cylinders, and having lugs and recesses corresponding to the lipped and non-lipped regions of the female connectors.

46. The blowout preventor assembly of claim 45, wherein the engagement profile and complimentary engagement profile are configured to retain the cylinder within the actuator receiving apertures in response to an insertion of the actuator into the actuator receiving aperture and rotation of the cylinder.

47. The blowout preventor assembly of claim 46, wherein the engagement profile within the at least one actuator receiving aperture comprises one or more grooves and the complimentary engagement profile comprises one or more lugs configured to engage the one or more grooves.

48. The blowout preventor of claim 45, further comprising:

a seal plate configured to permit rotation between the cylinder and the ram assembly.

49. The blowout preventor of claim 45, further comprising:

a removable seal cartridge fitted into a seal cartridge aperture of the cylinder.

50. The blowout preventor of claim 49, wherein the seal cartridge is fitted into the seal cartridge aperture by a threaded connection.

51. The blowout preventor of claim 45, wherein the ram assembly actuator is hydraulic.

52. A blowout preventor assembly comprising:

a body having at least one receiving aperture;

a cylinder adapted to be disposed within each of the at least one receiving apertures; and a quick lock mechanism adapted to secure each cylinder in a corresponding receiving aperture, the quick lock mechanism comprising:

an engagement profile within the at least one receiving aperture, where the engagement profile comprises female connectors, disposed in the receiving apertures, and having alternating lipped and non-lipped regions; and a complimentary engagement profile on the cylinder, where the complimentary engagement profile lugs and recesses corresponding to the lipped and non-lipped regions of the female connectors;

wherein the engagement profile and complimentary engagement profile are configured to retain the cylinder within the actuator receiving apertures in response to an insertion of the actuator into the actuator receiving aperture and rotation of the cylinder.

53. The assembly of claim 52, wherein the engagement profile within the at least one actuator receiving aperture comprises at least one groove and the complimentary engagement profile comprises at least one lug configured to engage the grove.

54. The assembly of claim 53, wherein the blowout preventor comprises a wireline blowout preventor, a coiled tubing blowout preventor, or a drilling blowout preventor.

* * * * *